US011993875B2

(12) United States Patent
Lonati et al.

(10) Patent No.: US 11,993,875 B2
(45) Date of Patent: May 28, 2024

(54) TURNING DEVICE FOR TUBULAR KNITTED ITEMS AND METHOD FOR TURNING TUBULAR KNITTED ITEMS

(71) Applicant: SANTONI S.P.A., Brescia (IT)

(72) Inventors: Andrea Lonati, Brescia (IT); Roberto Ranzenigo, Brescia (IT)

(73) Assignee: SANTONI S.P.A., Brescia (IT)

( * ) Notice: Subject to any disclaimer, the term of this patent is extended or adjusted under 35 U.S.C. 154(b) by 226 days.

(21) Appl. No.: 17/620,865

(22) PCT Filed: Jun. 19, 2020

(86) PCT No.: PCT/IB2020/055767

§ 371 (c)(1),
(2) Date: Dec. 20, 2021

(87) PCT Pub. No.: WO2020/255052

PCT Pub. Date: Dec. 24, 2020

(65) Prior Publication Data

US 2022/0325449 A1 Oct. 13, 2022

(30) Foreign Application Priority Data

Jun. 20, 2019 (IT) ..... 102019000009615

(51) Int. Cl.
*D04B 9/40* (2006.01)
*D04B 15/02* (2006.01)

(52) U.S. Cl.
CPC ..... *D04B 9/40* (2013.01); *D04B 15/02* (2013.01)

(58) Field of Classification Search
CPC . D04B 9/40; D04B 15/02; D06G 3/02; D06G 3/04

(Continued)

(56) References Cited

U.S. PATENT DOCUMENTS

2014/0338401 A1* 11/2014 Lonati ..... D04B 9/40 66/14
2015/0000348 A1* 1/2015 Lonati ..... D04B 9/10 66/8

(Continued)

FOREIGN PATENT DOCUMENTS

CN 108560128 A 9/2018
CN 109576884 A 4/2019

(Continued)

OTHER PUBLICATIONS

Search Report dated Sep. 11, 2020 in corresponding International Application No. PCT/IB2020/055767, 5 pages.
Written Opinion dated Sep. 11, 2020 in corresponding International Application No. PCT/IB2020/055767, 14 pages.

*Primary Examiner* — Danny Worrell
(74) *Attorney, Agent, or Firm* — MH2 TECHNOLOGY LAW GROUP LLP

(57) ABSTRACT

A turning device for sewing or grafting stations for automated closing of the tubular knitted items at a first end thereof includes a lower portion and an upper portion, arranged below and above an intermediate area on which can be positioned supporting means for the tubular item to be turned, hanging at its first axial end, and at least one tubular body to be inserted from below to above, with the upper axial end thereof, through the axial end of the item hanging from the supporting means for turning the tubular item. The device includes moving mechanisms for positioning the lower portion between a first operating position, in which it is vertically aligned with the upper portion, and a second operating position, in which it is displaced laterally with respect to the upper portion; a manipulating mechanism, movable between a non-operating position, in which it does not interact with the tubular item, and an operating position, in which it is placed above the tubular item. The switching of the manipulating mechanism from the non- (Continued)

operating position to the operating position takes place by catching the tubular item picked up by the knitting machine and placed close to the lower portion; the manipulating mechanism, in the operating position, manipulates and raises the tubular item so as to position a second free end thereof on the upper axial open end of the tubular item, thus causing or facilitating the insertion of the tubular item into the tubular body.

20 Claims, 17 Drawing Sheets

(58) Field of Classification Search
USPC ..... 66/147, 148, 149 S
See application file for complete search history.

(56) References Cited

U.S. PATENT DOCUMENTS

| | | | | |
|---|---|---|---|---|
| 2015/0354108 | A1* | 12/2015 | Lonati | D04B 9/40 66/185 |
| 2020/0056323 | A1* | 2/2020 | Inli | D04B 15/92 |
| 2022/0307167 | A1* | 9/2022 | Lonati | D04B 1/26 |
| 2022/0325449 | A1* | 10/2022 | Lonati | D04B 9/40 |

FOREIGN PATENT DOCUMENTS

| | | | | |
|---|---|---|---|---|
| EP | 3187632 | A1 | 7/2017 | |
| EP | 3715511 | A1 * | 9/2020 | A41H 43/02 |
| WO | WO-2009112348 | A1 * | 9/2009 | D04B 15/92 |
| WO | 2019197928 | A1 | 10/2019 | |
| WO | WO-2020255052 | A1 * | 12/2020 | D04B 15/02 |

* cited by examiner

TURNING DEVICE FOR TUBULAR KNITTED ITEMS AND METHOD FOR TURNING TUBULAR KNITTED ITEMS

CROSS-REFERENCE TO RELATED APPLICATIONS

This application is a U.S. National Stage application of PCT/IB2020/055767 filed Jun. 19, 2020, pending, which claims priority to Italian Application No. 102019000009615 filed Jun. 20, 2019, the entire disclosures of which are hereby incorporated by reference.

TECHNICAL FIELD

The present invention relates to a turning device for tubular knitted items, in particular for sewing or grafting stations for automated closing of the tubular knitted items at an axial end thereof. The present invention further relates to a method for turning a tubular knitted item.

BACKGROUND

It is known about techniques for automated closing of tubular knitted items, in particular socks, at an axial end thereof at the end of their manufacturing on circular knitting machines for knitted or hosiery items.

Some of these techniques are based on picking up he item, after it has been manufactured, from the circular knitting machine for knitted or hosiery items, and transferring it to a sewing or grafting station, generally placed on the side of the machine used for manufacturing the item.

The sewing or grafting station includes a sewing or grafting head by means of which the axial end of the item is closed, which end is usually the axial end at which the manufacturing of the item is ended.

Some techniques are based on using one device for both picking up the item from the machine which manufactured it and supporting the item during the sewing or grafting operation for closing the axial end thereof. Other techniques include a device for picking up the item and transferring it to the sewing and grafting station, and a manipulating device arranged in the sewing station and used for preparing the item for the following sewing or grafting operation and, if necessary, for moving the item during the sewing or grafting operating with respect to the sewing or grafting head.

Usually the item is picked up from the machine which manufactured it and transferred to the manipulating device by individually engaging the knitted loops of the last knitted course of the item, and the knitted loops of a half-course of this last knitted course are individually placed facing the knitted loops of the other half-course before sewing or grafting, so that the axial end of the item is closed by joining every time two loops mutually facing each other of the two half-courses making up the last knitted course. This method allows to obtain a very good result, as far as precision and appearance are concerned, for automated closing of axial ends of tubular knitted items, in particular socks.

In both techniques as mentioned above, it is typically envisaged that the sewing or grafting operation is carried out on the item once turned so that the sewing or grafting chain is hardly visible on the plain side of the item, i.e. on the side that is normally visible when wearing the item.

For this reason, sewing or grafting stations for implementing these techniques for closing an axial end of tubular knitted items generally include a turning device whose function is to turn the item picked up on its plain side from the machine which manufactured it, before sending it to the sewing or grafting operating and, if necessary, to turn it again so as to bring it on its plain side after the sewing or grafting operation.

One of the most common types of turning devices for this application is based on using a tubular body which is placed facing below the item supported by means of a picking device or by means of a manipulating device at an axial end thereof to be closed, and arranged basically vertical with such an axial end pointing upwards.

The tubular body is also placed with its axis in vertical position so as to face with its upper axial end the hanging item. The inner portion o the tubular body, and in particular its bottom end, is then connected to suction means so as to suck through its upper axial end the item which is however held, at the axial end thereof to be closed, by the picking device or by the manipulating device. Thus the item is placed inside the tubular body. Now the tubular body is then lifted so as to get, with the upper axial end thereof, through the axial end of the item engaged with the picking device or with the manipulating device. As a result of this, the item is turned inside out on the outer side surface of the tubular body and progressively taken out of the upper axial end of the tubular body, thus turning it.

Typically, known turning devices comprise a lower portion and an upper portion which are arranged below and above an intermediate portion, respectively, on which supporting means of the tubular item to be turned, hanging at an axial end thereof and basically arranged vertical, are positioned and operate; such supporting means are typically the aforesaid picking device or the aforesaid manipulating device.

In rest conditions the tubular body of the turning device is inserted into the lower portion of the turning device and is axially movable so as to turn the item from the plain side to the turned side and, if necessary, vice versa; during such operations the tubular body can move till it reaches the upper portion of the device.

For quite long tubular items, such as for tights, it may be difficult to obtain with such turning devices the complete turning inside out of the item on the outer side surface of the tubular body. Similar problems occur when the item should be brought back to the plain side by turning it again after the sewing or grafting operation on the item once turned. Indeed, such new (second) turning is typically carried out by sucking the item, previously turned inside out on the outer side surface of the tubular body after the first turning, inside the tubular body through the lower axial end of the tubular body itself. Here again, indeed, a quite long item can prevent itself from being completely sucked through the lower axial end of the tubular body of the turning device.

In order to solve this problem, turning devices with very long tubular bodies and thus with considerable overall height have been proposed, which are difficult to be placed and installed. As an alternative, turning devices equipped with horizontal axis rollers facing the outer side surface of the tubular body. Such rollers can be actuated in rotation around the respective axes and are movable getting closer to the outer side surface of the tubular body, so as to engage with the portion of the item that has already been turned inside out on the outer side surface of the tubular body and complete its turning inside out, or moving away from the outer side surface of the tubular body so as not to interfere with the latter in other operating conditions.

As disclosed above, once the item to be turned has been picked up from the manufacturing machine, the picking device holding the knitted loops of the last knitted course of the item is directed to the aforesaid intermediate portion of the turning device. In such situation, to help the item get into the tubular body, the use of another type of turning device is known, as described in patent EP2250307. In such type of turning device, when the item is transferred from the manufacturing machine to the sewing or grafting station, the lower portion of the turning device can be inclined with respect to the vertical axis, so as to get with the upper axial end of the tubular body whose inner portion is connected to suction means, closer to the manufacturing machine of the item. This approaching movement simplifies the suction, inside the tubular body through the upper axial end thereof, of the item hanging with its upper end from the picking elements of the picking device. The lower portion is then brought back with the axis of the tubular body on the vertical axis, so as to continue with the following turning operations of the tubular item and with the sewing and grafting operations of its axial end.

The Applicant has found that known turning devices, equipped with movable tubular bodies for turning the item to be closed, are not without drawbacks and can be improved.

Indeed, when the tubular item to be sewn or grafted on the axial end thereof is particularly long and/or heavy, e.g. due to the type of yarns used for manufacturing it, it may be difficult or even unfeasible to load it into the tubular body since neither the suction action nor the inclination, if any, of the lower portion of the turning device allow to complete the initial loading of the item, taken out of the manufacturing knitting machine and hanging from the picking device or from the manipulating device at its axial end to be closed, into the turning tube so as to continue with the turning and closing steps of the end. Basically, especially for tubular items such as socks that are quite long or particularly stiff or thick, e.g. made up of technical yarns, or that are structured or shaped in a particular manner (and thus with little flexibility), it is difficult to complete the step in which the tubular item is transferred from the circular knitting machine from which its was taken to the sewing or grafting station.

Moreover, it may be difficult to load the tubular item into the tubular body since it can be blocked during the introduction into the tubular body due to the material of the item itself piling up or heaping up on the upper axial end of the tubular body.

Further examples of a cycle including manufacturing, picking up and automated closing of a tubular knitted item, and of related units and devices, are described in patent documents WO2009112346, WO2009112347 and WO2009144049.

Moreover, further examples of turning devices for tubular items are described in patent documents WO2008028575 and WO2008028576.

Under these circumstances, an aim underlying the present invention, in its various aspects and/or embodiments, is to solve the problems disclosed above by carrying out a turning device for tubular knitted items, particularly for sewing or grafting stations for automated closing of the tubular items at an axial end thereof, which ensured the correct loading and turning even of heavy or thick items or of very long or even very stiff items.

It is a further aim of the present invention to carry out a turning device which has a high operating reliability and accuracy.

A further aim of the present invention is to provide a turning device for tubular knitted items characterized by a simple and rational structure.

A further aim of the present invention is to create alternative solutions to the prior art for carrying out turning devices for tubular knitted items, and/or to open new design possibilities.

These and other possible aims, which shall appear better from the following description, are basically achieved by a turning device for tubular knitted items and by a method for turning a tubular knitted item, according to one or more of the appended claims and according to the following aspects and/or embodiments, variously combined, possibly also with the aforesaid claims.

In the present description and in the appended claims, the words "upper" and "lower" as well as "vertically", "axially" and similar relate to the positioning of the turning device and of the circular knitting machine during normal operation (with the central axis of rotation in vertical position and the cylinder needles pointing upwards).

SUMMARY

Some aspects of the invention are listed below.

In a first and more general aspect, the invention relates to a turning device for tubular knitted items, in particular for sewing or grafting stations for automated closing of tubular items at a first axial end thereof, said tubular items being preferably manufactured by means of a circular knitting machine for knitted or hosiery items and extending longitudinally between a first and a second open end.

In one aspect, the device comprises:

- a lower portion and an upper portion, placed below and above an intermediate area, respectively, on which can be or are positioned supporting means for the tubular item to be turned, hanging at the first end thereof, with the second end being free, and arranged basically vertical;
- at least one tubular body to be inserted from below to above, with the upper axial end thereof, through said axial end of the item hanging from said supporting means (after inserting the item through said upper axial end of the tubular body), for turning inside out the tubular knitted item, held by said supporting means, on the outer side surface of said tubular body, progressively taking the item out of said upper axial end of the tubular body, so as to turn the tubular item with respect to the configuration with which it initially hangs from the supporting means.

In one aspect, the device comprises moving mechanisms configured for selectively positioning said lower portion at least between a first operating position, in which said lower portion is vertically aligned with said upper portion, and a second operating position, in which said lower portion is at least partially displaced laterally with respect to said upper portion, preferably getting closer to the knitting machine used for manufacturing the tubular item, and wherein, in said second operating position, said tubular body is supported by said lower portion.

In one aspect, the device comprises a manipulating mechanism, movable upon command at least between a non-operating position, in which it does not interact with the tubular item, and an operating position, in which it is at least partially placed above said tubular body supported by the lower portion.

In one aspect, the switching of the manipulating mechanism from the non-operating position to the operating position takes place by at least partially catching the tubular item picked up by the knitting machine and placed close to said lower portion.

In one aspect, the manipulating mechanism, when in said operating position, is configured for manipulating and raising at least partially the tubular item, so as to place the second, free end of the tubular item on the upper axial, open end of the tubular body, so as to cause and/or simplify the insertion of the tubular item, starting from the second end thereof, into the tubular body.

In one aspect, the manipulating mechanism is configured, when in said operating position, for catching and raising a middle portion of the tubular item placed in a continuous manner between the first end and the second end, so as to raise the second end and orient it at the entry of the upper axial end of the tubular body.

In one aspect, the lower portion and the upper portion of the turning device exhibit each a respective longitudinal development along a vertical axis thereof, and are positioned, when the lower portion is in said first position, coaxial one to the other, along a main axis of the turning device.

In one aspect, the switching of the lower portion between said first operating position and said second operating position takes place by shifting, along a direction preferably perpendicular to said main axis.

In one aspect, in said second operating position the lower portion is shifted laterally, towards the knitting machine used for manufacturing the tubular item, of a first distance with respect to the first operating position.

In one aspect, said moving mechanisms comprise a slide or carriage having a fixed part, integral with the knitting machine used for manufacturing the tubular item, and a movable part, onto which the lower portion is integrally mounted.

In one aspect, said manipulating mechanism comprises a first linear actuator provided with a base body, integral with the knitting machine used for manufacturing the tubular item, or with said lower portion of the turning device, and a movable body, which can be shifted with respect to said base body.

In one aspect, the movable body can be shifted along a raising axis parallel to said main axis.

In one aspect, said raising axis is laterally spaced from said main axis.

In one aspect, said movable body is configured for rising vertically from below to above, when the manipulating mechanism reaches said operating position, above the tubular body supported by the lower portion, when the latter is shifted by said moving mechanisms to said second operating position.

In one aspect, the movable body of the manipulating mechanism ends with a supporting element configured for supporting the tubular item to be turned, hanging at its first end from the supporting means. In one aspect, the supporting element receives resting thereon the outer portion of the tubular item and raises the whole tubular item to a given height so as to place the second, free end of the tubular item at the upper axial, open end 6A of the tubular body.

In one aspect, the supporting element has a rod-like shape suitably shaped so as to receive resting thereon and to support the tubular item caught when getting close to the lower portion.

In one aspect, the manipulating mechanism:

when in said non-operating position, exhibits said supporting element in a backward position, in which it does not obstruct the space above the upper axial end of the tubular body, and wherein in said operating position, exhibits said supporting element in a forward position, in which it lies in the space above the upper axial end of the tubular body so as to catch and manipulate the tubular item picked up from the knitting machine and placed close to said lower portion.

In one aspect, the switching of the supporting element between the backward position and the forward position takes place by means of a rotation of the supporting element around an axis, preferably coincident with said raising axis.

In one aspect, the manipulating mechanism comprises a forward actuator configured for selectively moving the supporting element between the backward position and the forward position.

In one aspect, said base body is a fluid dynamic cylinder and the movable body is a piston that can be selectively shifted with respect to the cylinder and ends with said supporting element.

In one aspect, said supporting means of the item to be turned comprise a manipulating device provided with a body shaped as a circular crown, arranged with its axis on the main vertical axis and supporting a plurality of tips arranged according to an ideal cylindrical surface, whose axis coincides with the axis of said body of the manipulating device, and apt to support the tubular item to be turned and hanging at an axial end thereof.

In one aspect, said tubular body can be supported by said lower portion or by said upper portion.

In one aspect, the inside of said tubular body can be connected to pneumatic suction means. In one aspect, said pneumatic suction means are part of the turning device.

In one aspect, said pneumatic suction means are configured for sucking into the tubular body, through its upper axial end, the tubular item which is however held, at its first end to be closed, by the picking device or by the manipulating device, thus placing the item inside the tubular body.

In one aspect, the tubular body is movable under control at least from a lowered position, in which it faces with its upper axial end below said body of the manipulating device, to a raised position, in which it is arranged with its upper axial end above said body of the manipulating device and with its lower axial end near said body of the manipulating device, so as to get through said body of the manipulating device and turn inside out at least partially the tubular item, hanging from said manipulating device and preferably sucked through the upper axial end of said tubular body, on the outer side surface of said tubular body, and vice versa.

In one aspect, the lower portion of the turning device comprises lower supporting means for the tubular body with its axis arranged on said main vertical axis, and lower actuating means for said tubular body along said main vertical axis so as to make said tubular body get through said body of the manipulating device starting from said lowered position to said raised position, and vice versa.

In one aspect, the upper portion of the turning device comprises upper supporting means that can be engaged with the upper axial end of said tubular body for raising it along said main vertical axis from said raised position to a more raised position, in which the lower axial end thereof is distanced above with respect to said body of the manipulating device, and vice versa.

In one aspect, said lower supporting means and said upper supporting means are apt to selectively connect the inside of said tubular body to said pneumatic suction means.

In one independent aspect thereof, the present invention relates to a circular knitting machine for knitted or hosiery items, comprising:

stitch formation mechanisms, for instance a needle-holding cylinder and/or a needle-holding plate provided with a plurality of needles, configured for manufacturing tubular knitted items;

a sewing or grafting station, comprising a sewing or grafting head configured for automated closing of the first axial end of the tubular item on which the manufacturing of the tubular item ends;

means for picking up and supporting (or for propping) the tubular item to be turned, configured for picking up the tubular item manufactured by the stitch formation mechanisms and for transferring it to said sewing or grafting station, holding it supporting during the sewing or grafting operation for closing the first axial end thereof;

a turning device according to one or more of the above aspects, operatively placed between said stitch formation mechanisms and said sewing or grafting station, and configured for cooperating with said means for picking up and supporting the tubular item so as to operate at least a controlled turning of the tubular item.

In one aspect, said second operating position taken by the lower portion gets closer, preferably by shifting, to the stitch formation mechanisms and/or to the means for picking up and supporting the tubular item to be turned.

In one aspect, whatever the moving trajectory of the means for picking up and supporting the tubular item to be turned, when transferring the item from the stitch formation mechanisms to the turning device, the aforesaid second operating position taken by the lower portion is getting closer, preferably by shifting or rotational shifting, to the means for picking up and supporting the tubular item (during or after their moving trajectory), so as to allow the manipulating mechanism, when switching from the non-operating position to the operating position, to at least partially catch the tubular item to raise it and insert it and/or help it to get inserted into the tubular body.

In one independent aspect thereof, the present invention relates to a method for turning tubular knitted items, in particular designed to be implemented in sewing or grafting stations for automated closing of tubular items at an axial end thereof, the method comprising:

arranging means for manufacturing tubular knitted items, said manufacturing means being preferably a circular knitting machine for knitted or hosiery items;

arranging a turning device for tubular knitted items according to one or more of the above aspects;

arranging supporting means for the tubular item to be turned, from which a tubular item hangs at a first axial end thereof and is arranged basically vertical;

positioning, by means of said moving mechanisms, said lower portion in said second operating position, and positioning said manipulating mechanism in said non-operating position;

shifting the tubular item, by means of said supporting means, on said lower portion, placed in second operating position, or on said intermediate area of the turning device, so that the tubular item covers or gets through or crosses, at least partially, the upper end of the tubular body;

shifting said manipulating mechanism to said operating position, in which it is at least partially placed above said tubular body supported by the lower portion, catching and raising at least partially the tubular item so as to position the second, free end of the tubular item on the upper axial, open end of the tubular body, thus causing and/or helping the insertion of the tubular item into the tubular body.

In one aspect, in said step of shifting the tubular item, the tubular item is shifted so as to cover or get through or cross the upper end of the tubular body for a sufficient area so that the manipulating mechanism catching the tubular item causes the second end to be raised and the item to be positioned or at least partially inserted into the tubular body.

In one aspect, the method comprise, preferably after the insertion of the tubular item into the tubular body, one of more of the following steps:

shifting said manipulating mechanism back to said non-operating position;

placing, by means of said moving mechanisms, said lower portion in said first operating position;

inserting the tubular body from below to above, with the upper axial end thereof, through the first axial end of the item hanging from said supporting means, so as to cause the item to be turned inside out, held by said supporting means, on the outer side surface of the tubular body, progressively taking the item out of said upper axial end of the tubular body, so as to turn the tubular item with respect to the configuration with which it hangs from the supporting means;

with the tubular body raised and supported by the upper portion of the turning device, closing, by sewing or grafting, the first end of the tubular item;

placing, by means of said moving mechanisms, said lower portion in said third operating position and actuating said counter-turning mechanism so as to insert it vertically, from below to above, into the lower axial end of the tubular body, supported by the upper portion, on whose outer side surface the tubular item is wound, so as to operate and/or help a counter-turning of the tubular item with the upper axial end closed;

pushing the tubular item out of the upper axial end of the tubular body.

In one aspect, when loading the tubular item to be turned, hanging from the propping means, into the tubular body supported by the lower portion, the method comprises a step of generating a pneumatic suction from below into the tubular body, so as to promote the insertion of the tubular item into the upper axial end of the tubular body.

In one aspect, when the tubular item is counter-turned with the upper axial end closed or when pushing the tubular item out of the upper axial end of the tubular body, the method comprises a step of generating a pneumatic suction from above into the tubular body, so as to cause or promote the tubular item to get out from the upper axial end of the tubular body supported by the upper portion.

Further characteristics and advantages shall be more evident from the detailed description of a preferred, though not exclusive, embodiment of a turning device for tubular knitted items and of a method for turning a tubular knitted item according to the present invention.

BRIEF DESCRIPTION OF THE DRAWINGS

This description shall be made below with reference to the accompanying drawings, provided to a merely indicative and therefore non-limiting purpose, in which:

FIGS. 5-14 are obtained;

In FIG. 5-16 all the elements of the complete machine of FIG. 1, or of the turning device of FIG. 3, are omitted for the sake of simplicity and clarity.

DETAILED DESCRIPTION

With reference to the mentioned figures, the numeral 1 globally designates a turning device for tubular knitted items according to the present invention.

The turning device shall be described with reference to its preferred use in a sewing or grafting station S for automated closing of an axial end of a tubular knitted items 100, such as for instance a sock, manufactured on a circular knitting machine M for knitted or hosiery items, notwithstanding the fact that the turning device according to the invention may be used in a more general manner simply to turn a tubular item whether or not an axial end thereof is closed by sewing or grafting.

Figure 11:
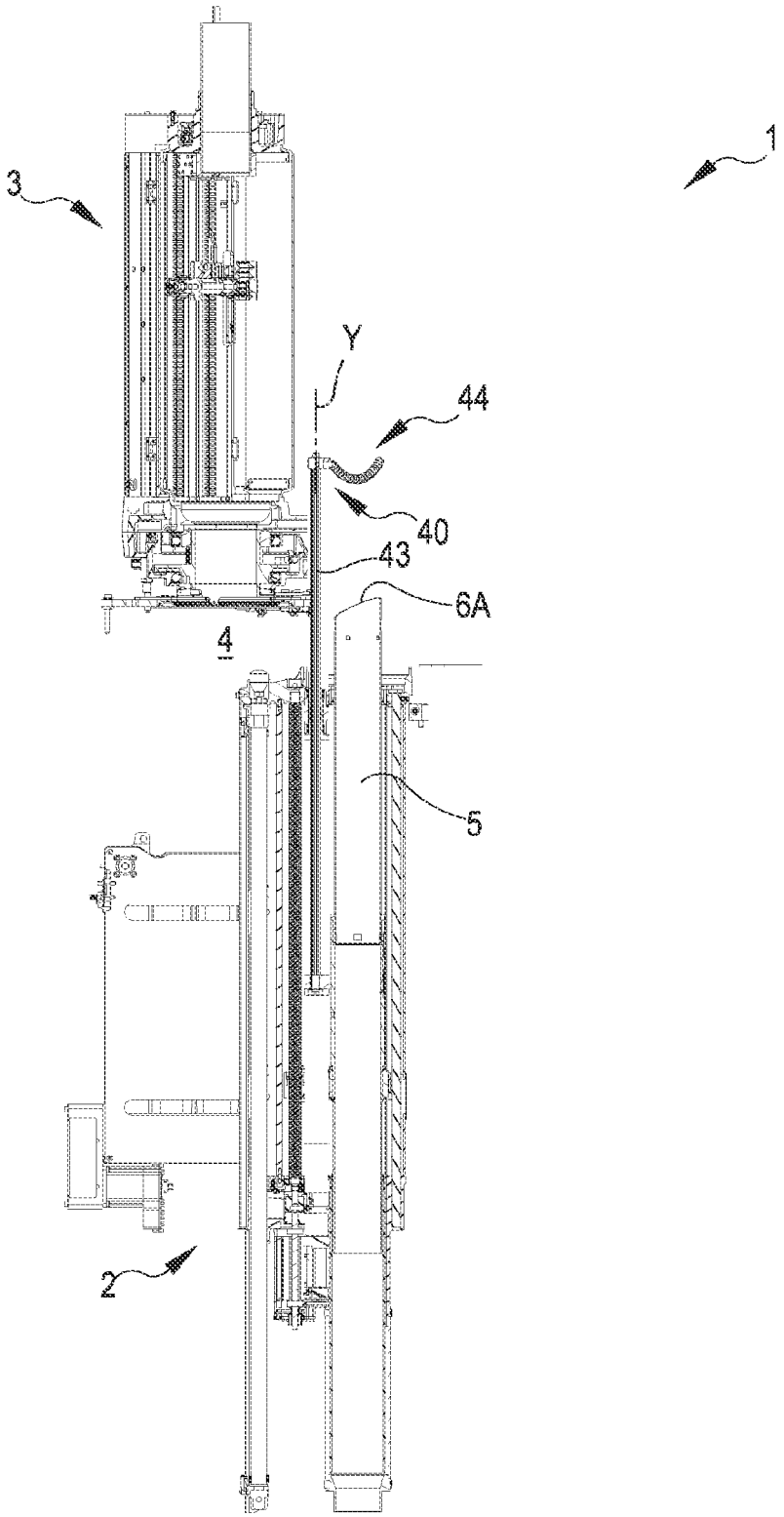
Figure 11A:
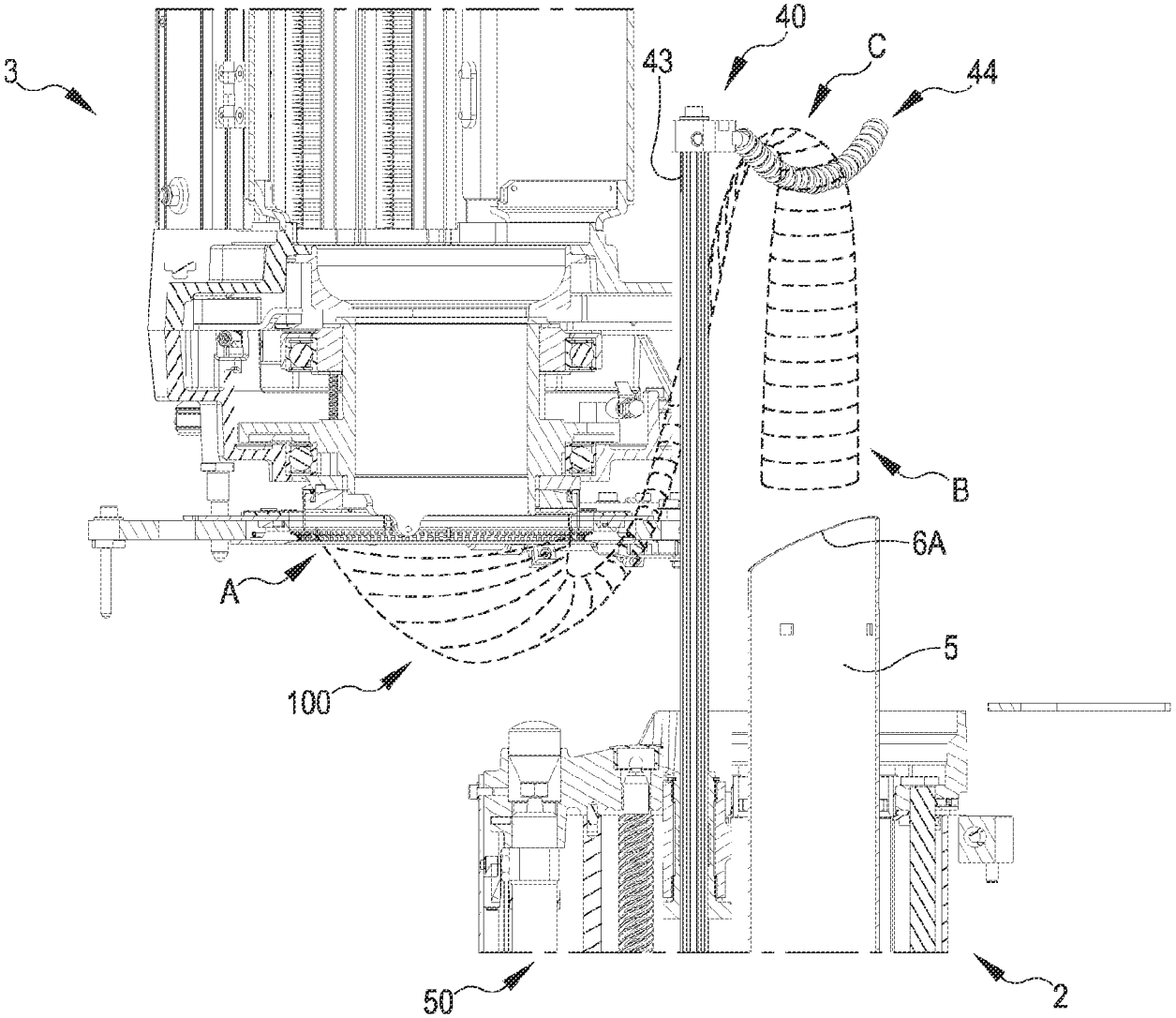

Let us consider first of all that the tubular item 100, shown schematically in FIG. 11A, extends longitudinally (or axially) between a first end, referred to with A, and a second end, referred to with B, both being open. The first end A is the one designed to be closed by sewing or grafting, thus becoming the closed toe of the sock.

With reference to the figures mentioned, the turning device 1 basically comprises a lower portion 2 and an upper portion 3, which are placed below and above an intermediate area 4, respectively, on which supporting means for the tubular item 100 to be turned can be or are positioned. The tubular item 100 to be turned is hanging at its first axial end A and is basically arranged vertical, the second end B being free.

The turning device 1 comprises a tubular body 5 which can be inserted, from below to above, with its upper axial end 6A, through the first end A of the item 100 hanging from the supporting means, after the item 100 has been inserted through such upper axial end of the tubular body 5 (the initial loading and inserting operations of the tubular item into the tubular body shall be discussed specifically in the description below). Thus, the insertion of the tubular body 5 into the first end A of the tubular 100 item causes the item itself to be turned inside out, held by the supporting means, on the outer side surface of the tubular body 5 progressively taking out the item 100 from the upper axial end of the tubular body 5.

Figure 7:
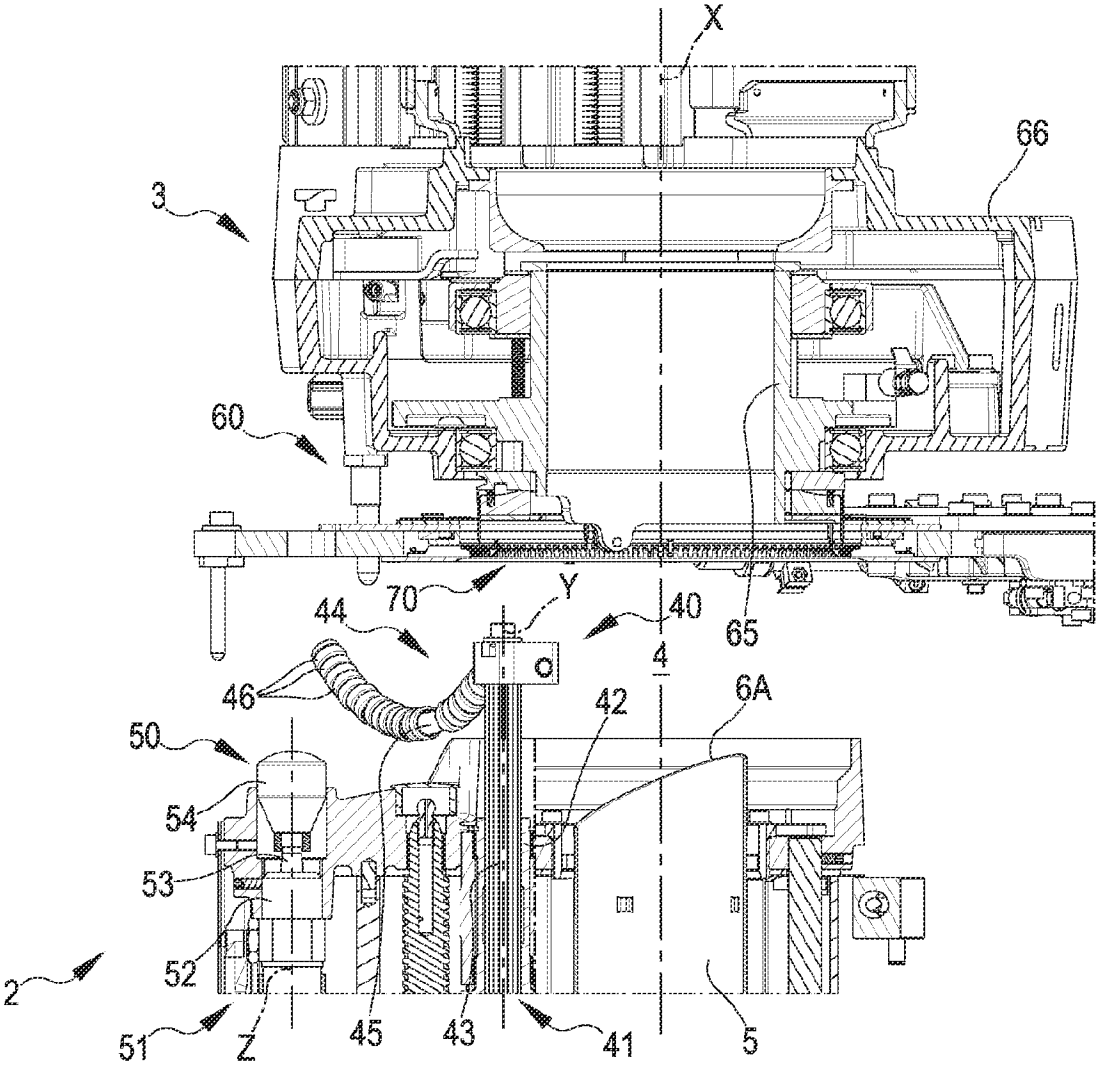
FIG. 7 shows a magnified view of the intermediate area of the turning device, and partially the upper portion and the lower portion, sectioned as in FIGS. 5 and 6.
Figure 8:
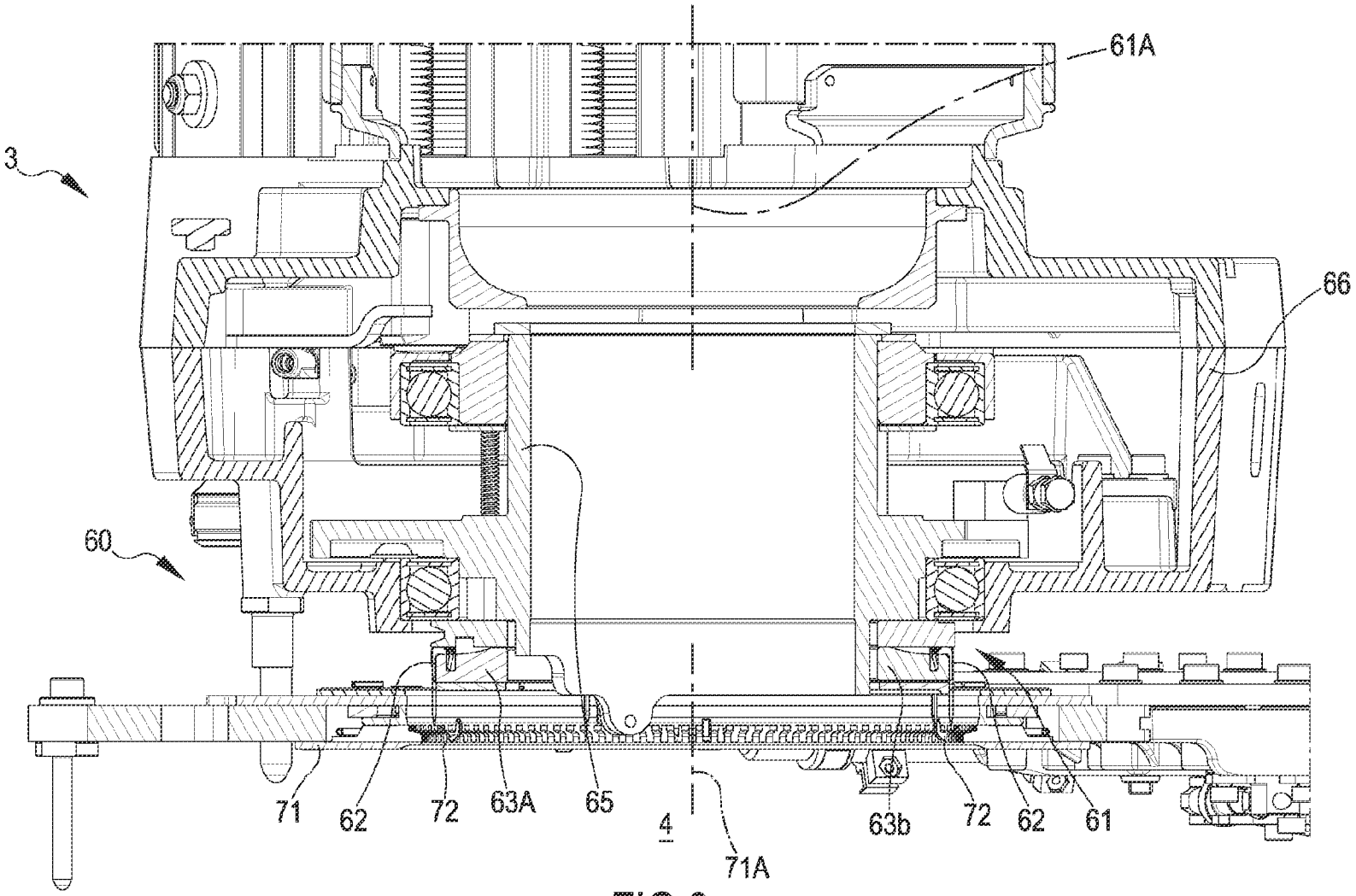
FIG. 8 shows a magnified portion of FIG. 7.

More specifically, the supporting means of the tubular item 100, arranged in the intermediate area 4 between the lower portion 2 and the upper portion 3 of the turning device 1, comprise a manipulating device 60 (see in particular FIGS. 7 and 8) provided with a body 61 shaped as a circular crown, arranged with its axis or main axis 61A vertical. The body 61 is provided on its lower face with a plurality of tips 62 arranged according to an ideal cylindrical surface whose axis coincides with the axis 61A, and developing parallel to such axis 61A. These tips 62 are apt to support the item 100 to be turned and hanging from the tips 62 with its first end A, and the tubular body 5 can be positioned with its axis on the vertical axis 61A and is movable under control along such axis.

Should the turning device, as in the embodiment shown, be designed to be placed in a sewing or grafting station S for closing the axial end of the item 100, the body 61 of the manipulating device 60 is made up of two half-crowns 63*a*, 63*b* hinged one to the other around a diametral axis. One of the two half-crowns can be tipped under control with respect to the other half-crown around the diametral axis so as to make each tip 62 of a half-crown face and align with a corresponding tip 62 of the other half-crown. Preferably, when the two half-crowns 63*a*, 63*b* are co-planar one to the other, the tips 62 point with their end downwards and a half-crown can be tilted around the diametral axis so as to face below the other half-crown.

The manipulating device 60 can be movable from the sewing or grafting station S to the knitting machine M, used for manufacturing the item 100 to be turned, and vice versa so as to pick up itself the item 100 from the machine and transfer it to the sewing or grafting station S.

As an alternative, as in the embodiment shown, the manipulating device 60 is arranged permanently in the sewing or grafting station S and the item 100 to be turned is picked up from the machine which manufactured it, and transferred to the manipulating device 60 by means of a picking device, globally referred to with the numeral 70.

The picking device 70 comprises a picking body 71 shaped as a circular crown, with axis 71A, supporting a plurality of picking mechanisms 72. Each picking mechanism 72 has a plate-shaped body arranged in a radial plane with respect to the axis 71A and movable under control getting closer to or away from the axis 71A.

The picking body 71 is arranged with its axis 71A vertical. The picking mechanisms 72 are angularly spaced in a regular manner around the axis 71A and based on the angular spacing between the needles of the circular machine M for knitted or hosiery items used for manufacturing the item 100, so that by positioning the picking body 71 coaxial around the needle cylinder of the machine and by suitably shifting it along its axis 71A, each picking mechanism is radially facing a needle of the machine. In the embodiment shown, the mechanisms 72 exhibit their end pointing towards the axis 71A shaped as an upwards open hook. This end can be engaged with the corresponding needle of the machine, facing which each picking mechanism 72 is placed so as to pick up the knitted loop from such needle removing the item 100 (in particular the first end A thereof) from the machine which manufactured it. The same end of each picking mechanism 72 can be coupled with a tip 62 so as to transfer the item 100 from the picking device 70 to the manipulating device 60. Indeed, the tips 62 are angularly spaced from each other around the axis 61A in a regular manner according to an angular spacing corresponding to the one between the picking mechanisms 72 of the picking device 70. In practice, each picking mechanism 72 corresponds to a tip 62 of the manipulating device 60 and when the picking device 70 is placed in the sewing or grafting station S, the picking body 71 is coaxial with the body 61 of the manipulating device 60 with the picking mechanisms 72 arranged around the crown of tips 62 and with each picking mechanism 72 radially and angularly aligned with a tip 62.

The knitted loops of the first end A of the item 100 are transferred from the picking mechanisms 72 to the tips 62 of the manipulating device 60 by positioning the picking body 71 coaxial below with the body 61 and engaging the end of each picking mechanism 72 with one of the tips 62 while the half-crown 63*b* is coplanar with the half-crown 63*a*, i.e. before tilting it below the half-crown 63*a*.

In the embodiment shown, the body 61 is coaxially connected around a hollow cylinder 65, with vertical axis, which is supported, turning around its axis coinciding with the axis 61A, by a supporting structure 66.

It is further provided for suitable means, e.g. as those shown in the aforesaid patent documents, for tilting the half-crown 63*b* around the diametral axis, so that the half-crown 63*b* switches from the position coplanar with the half-crown 63*a* to be position tiled below the latter, or vice versa.

It is suitably provided for first axial pushing means, which interact with the picking mechanisms 72 of the picking device 70 when these are coupled with the tips 62, and with the tips 62 themselves of the manipulating device 60 so as to individually switch the knitted loops from the picking mechanisms 72 to the tips 62, obviously if the picking device 70 is present.

It is further provided for second axial pushing means, which interact with the tips 62 of the manipulating device 60 for switching the knitted loops from the tips 62 of the half-crown 63*a* to the tips 62 of the half-crown 63*b* when this is tilted below the half-crown 63*a*, or for disengaging the item 100 from the tips 62 of the half-crown 63*b* after the sewing or grafting operation.

The lower portion 2 and the upper portion 3 of the turning device 1 exhibit each a respective longitudinal development along a vertical axis thereof, and can be preferably positioned, in a starting or rest or non-use configuration, coaxial one to the other, along a main axis X of the turning device 1. This configuration is shown e.g. in FIGS. 1-4, 7, 9 and 12. Preferably, in this configuration the lower portion 2 and the upper portion 3 of the turning device 1 are positioned with their vertical axes coinciding also with the afore said main axis 61A. Preferably, the tubular body 5 can be selectively supported by the lower portion 2 or by the upper portion 3.

The lower portion 2 of the turning device 1 comprises lower supporting means for the tubular body 5 and lower actuating means for the tubular body 5 itself along the axis X so as to make said tubular body 5 get through the body 61 of the manipulating device 60 starting from a lowered position (FIGS. 9-11), in which the tubular body 5 faces with its upper axial end below the body 61 of the manipulating device 60, to a raised position, in which it is arranged with its upper axial end 6A above the body 61 of the manipulating device 60 and with its lower axial end 6B near the body 61 of the manipulating device 60.

Figure 1:
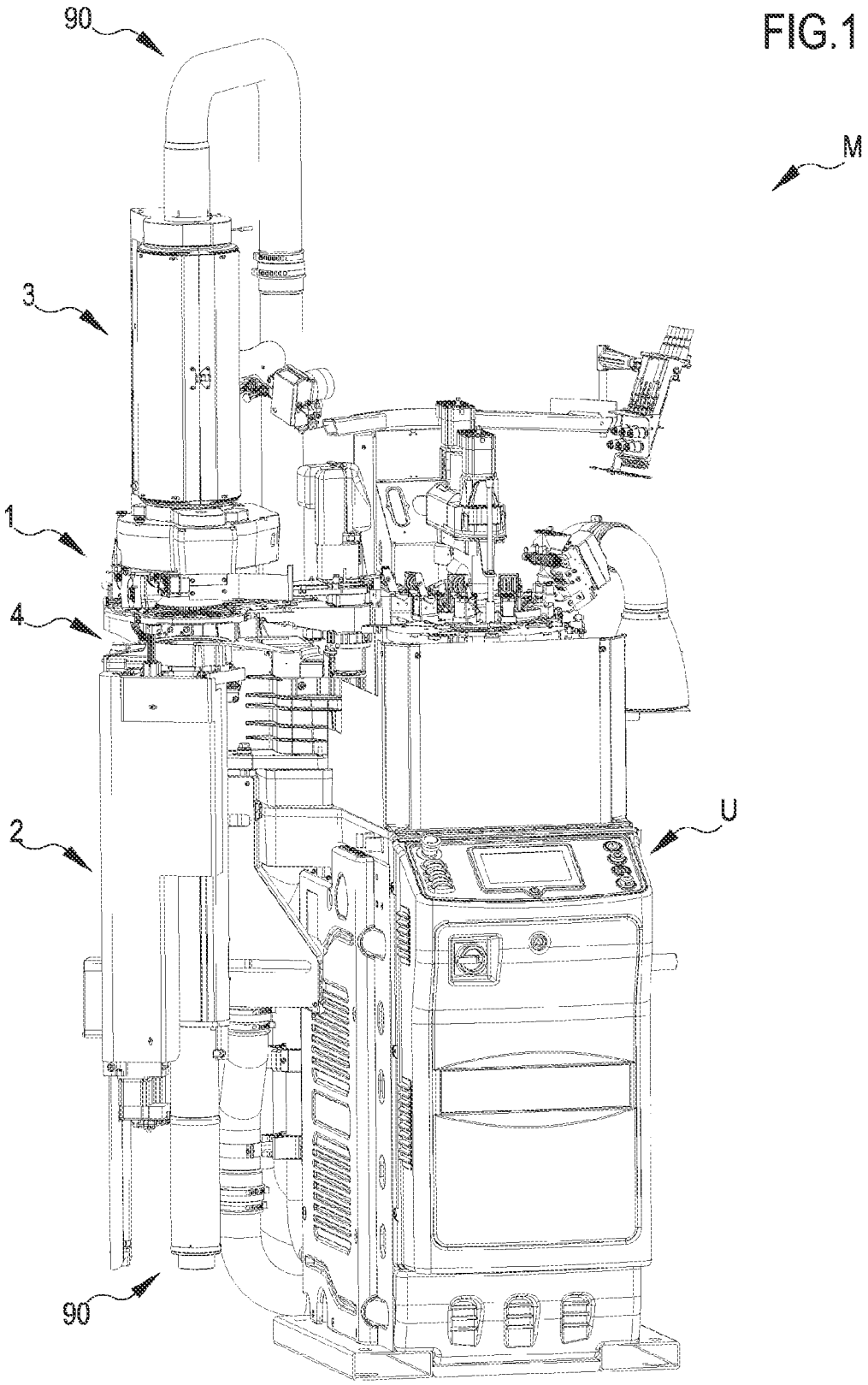
FIG. 1 shows a circular knitting machine to which a turning device for tubular knitted items according to a possible embodiment of the present invention is associated.
Figure 2:
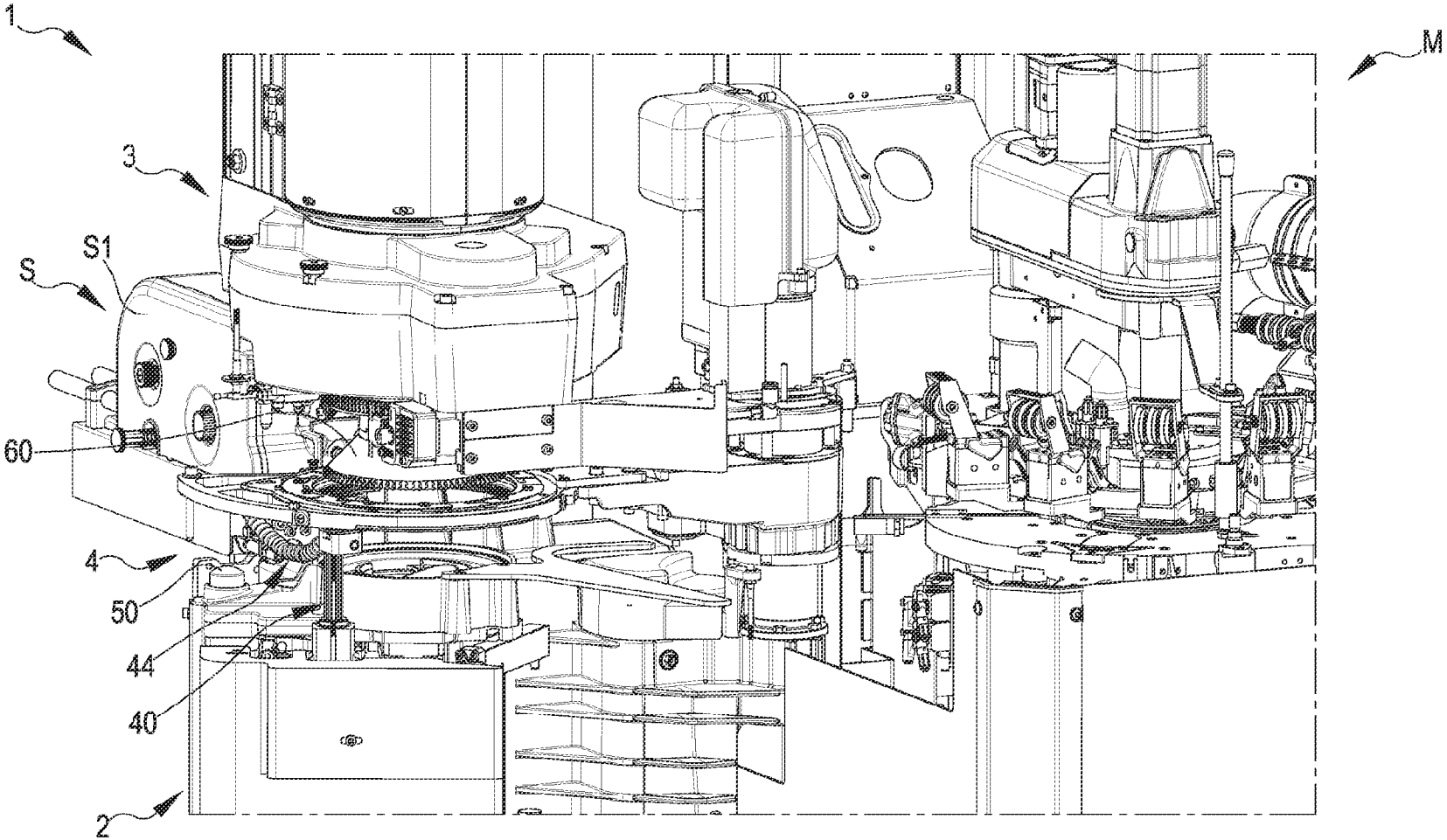
FIG. 2 shows a magnified portion of the circular knitting machine and of the turning device of FIG. 1.
Figure 3:
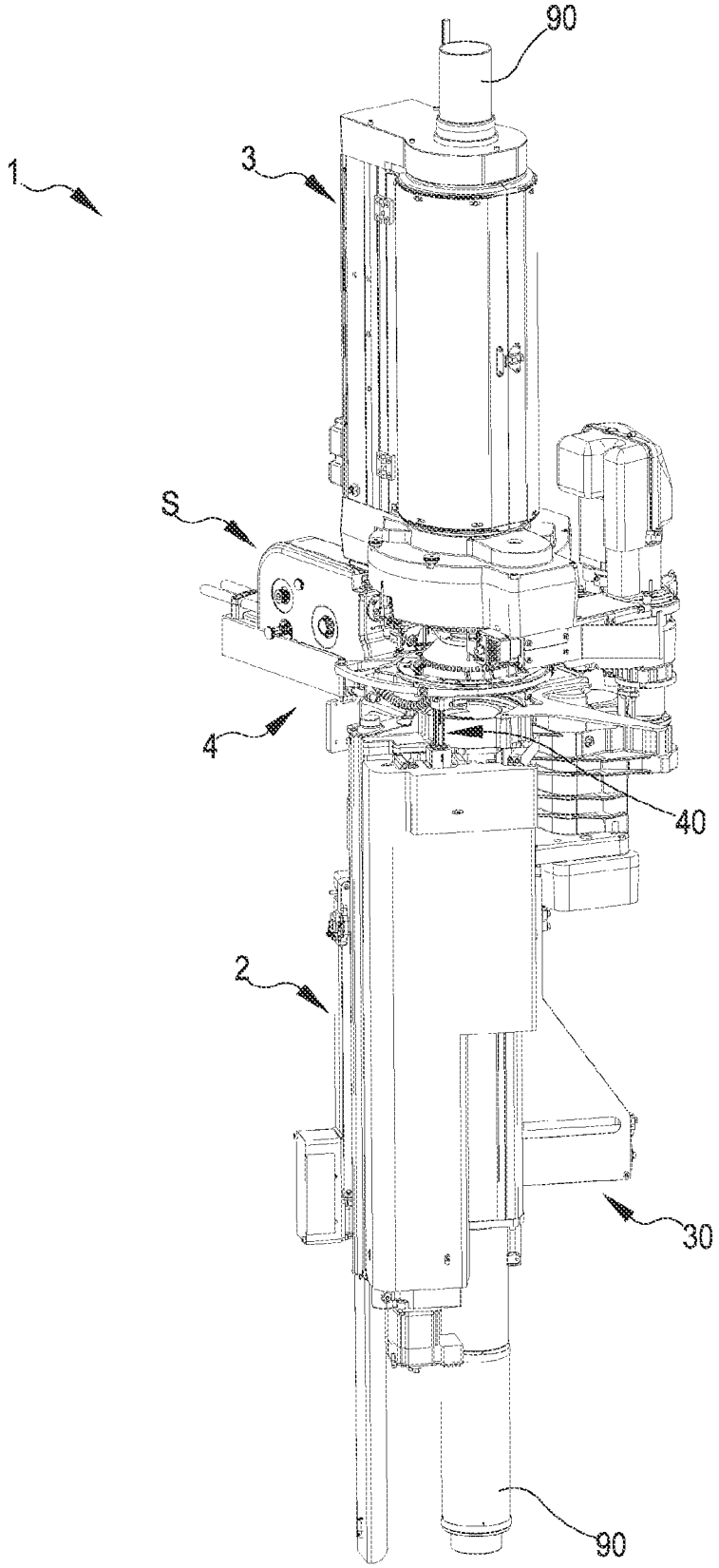
FIG. 3 is a perspective view of the turning device for tubular knitted items according to the present invention only, corresponding to the turning device mounted to the knitting machine of FIG. 1.
Figure 4:
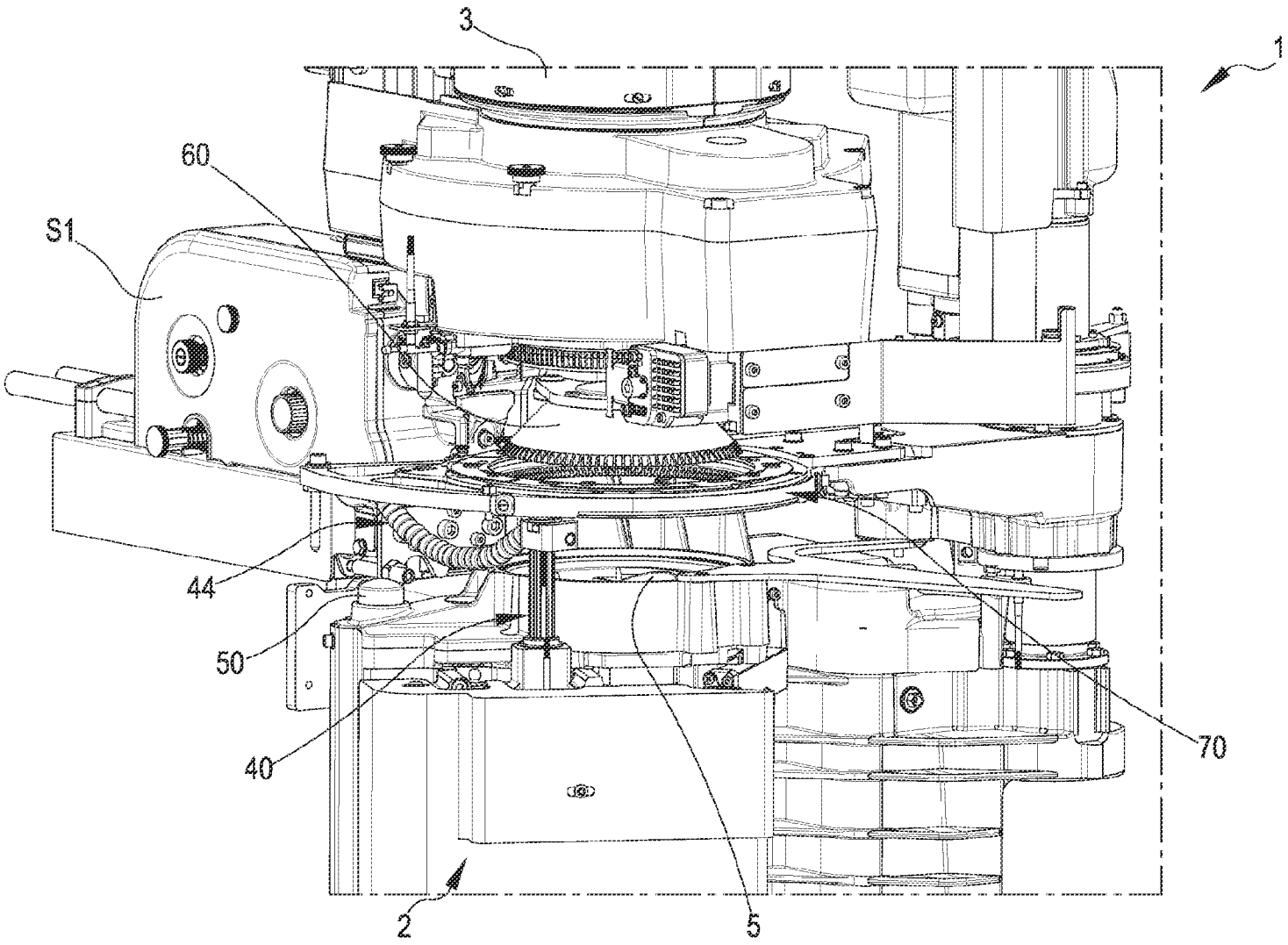
FIG. 4 shows a magnified portion of the turning device of FIG. 3.
Figure 5:
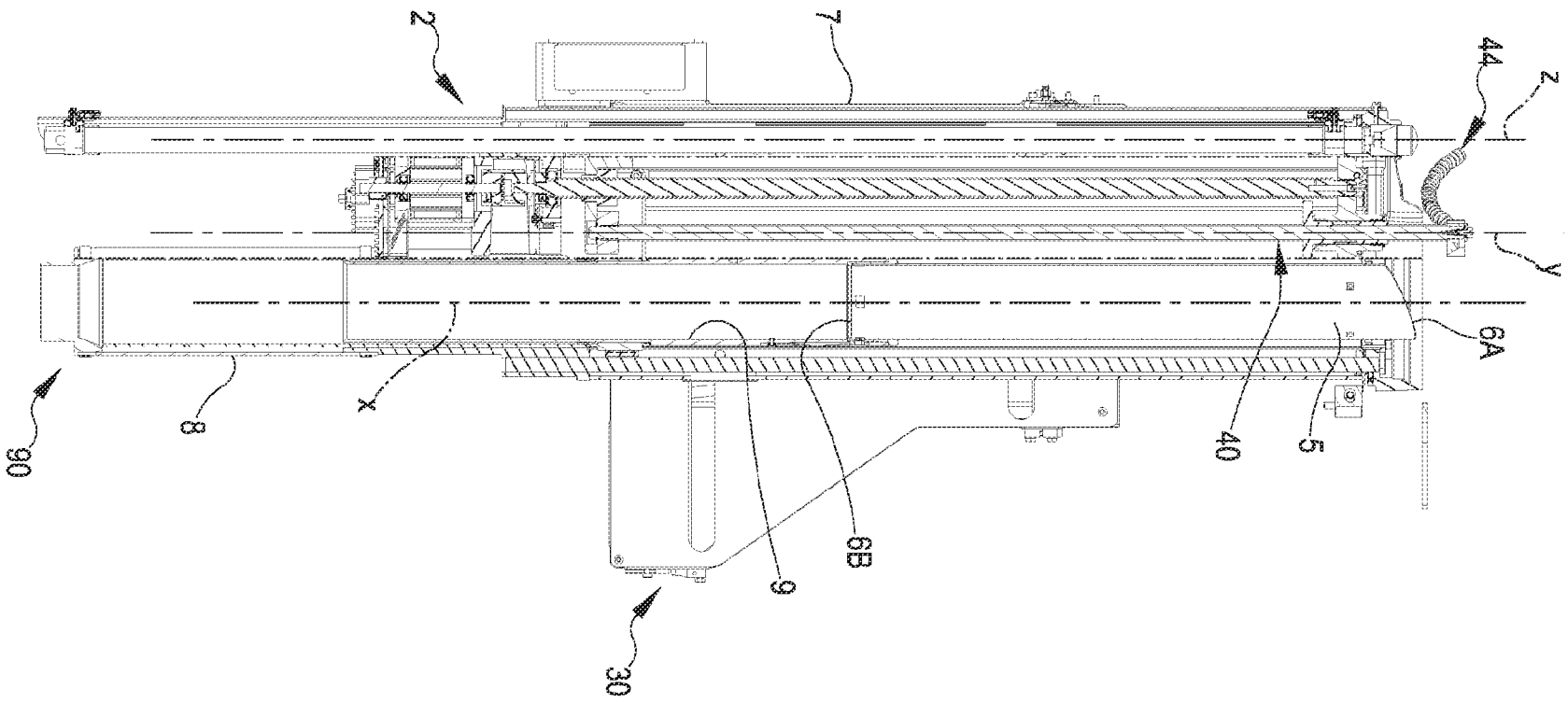
FIG. 5 schematically shows the lower portion of the turning device, sectioned and arranged with its axis in vertical direction.

In further detail, the lower supporting means of the tubular body 5, as shown more specifically in FIG. 5, comprise a lower supporting structure 7 which can be part of the aforesaid supporting structure 66 or be an independent supporting structure. The lower supporting structure 7 supports a basement 8 to which a hollow lower guiding cylinder 9 is integrally connected. The lower guiding cylinder 9 is fastened to the basement 8 with its lower end.

The lower guiding cylinder 9 is apt to support in an axially sliding manner the tubular body 5, open at its axial ends 6A an 6B, which can be fitted coaxially around the lower guiding cylinder 9.

The lower actuating means, for switching the tubular body 5 from the lowered position to the raised position as mentioned above, can comprise a linear motor or a screw-nut mechanism or also a pneumatic or fluid dynamic cylinder; these means enable a selective management of the shift, along the axis X, of the tubular body 5 inside the lower portion 2 of the turning device 1.

The position of the tubular body 5 along the axis X can be controlled by means of dedicated sensors, e.g. optical or resistive sensors.

The upper portion 3 of the turning device comprises upper supporting means that can be engaged with the upper axial end of the tubular body 5 and upper actuating means for further raising the tubular body 5 from the aforesaid raised position, which can be obtained with the lower actuating means, to a more raised position (FIGS. 12-14), in which the lower axial end 6B thereof is distanced above with respect to the body 61 of the manipulating device 60.

Figure 6:
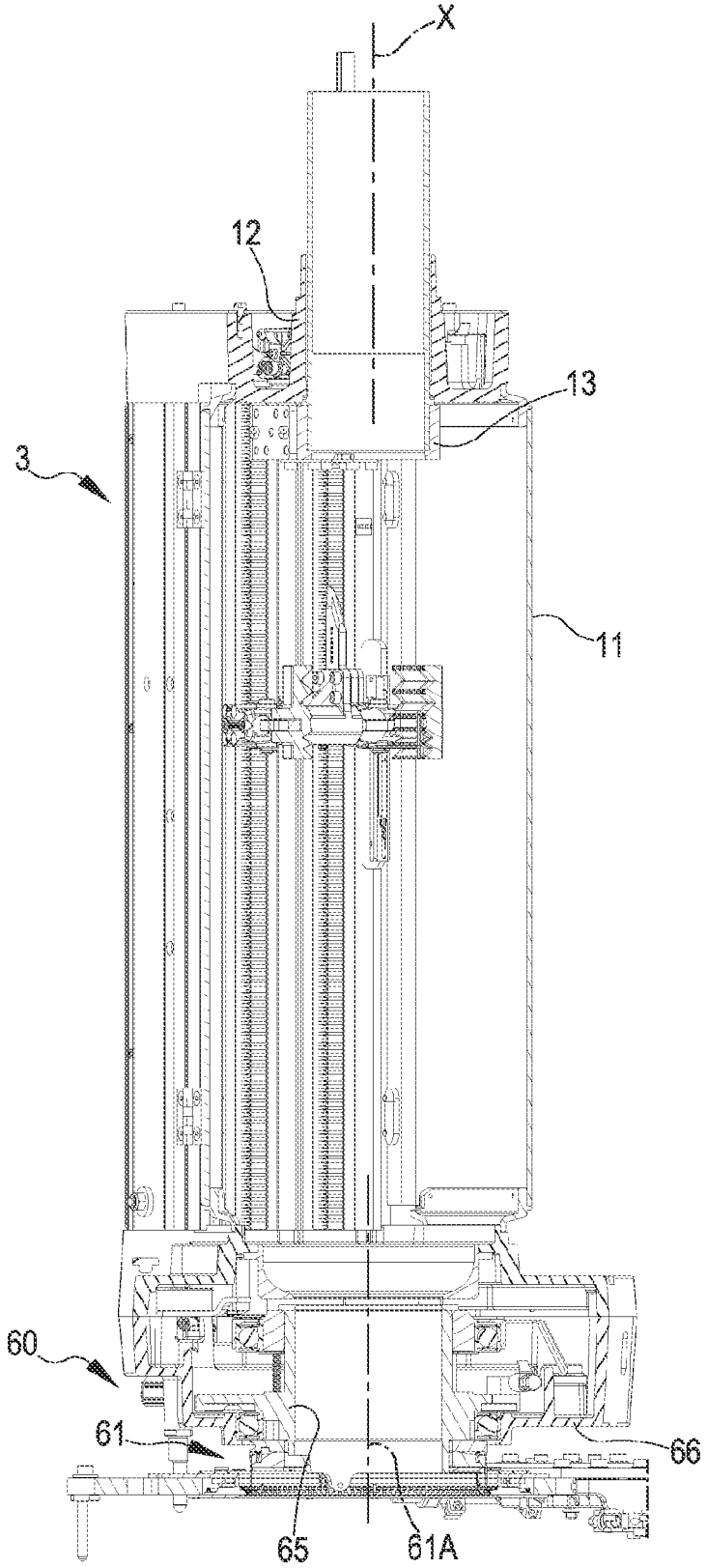
FIG. 6 schematically shows the upper portion of the turning device, sectioned and arranged with its axis in vertical direction.

In further detail, as shown especially in FIG. 6, the upper portion 3 comprises an upper supporting structure 11 which can be an integral part of the lower supporting structure 7 or be an independent supporting structure.

The upper supporting structure 11 supports a fixed upper sleeve 12, which is arranged above and coaxial with the hollow cylinder 65.

The upper supporting means and the upper actuating means can comprise a movable upper sleeve 13, which is coupled inside and coaxial with the fixed upper sleeve 12 and which is axially movable with respect to the latter.

The lower end of the movable upper sleeve 13 can be coupled with the upper axial end of the tubular body 5 and is provided with blocking means for hooking this upper axial end of the tubular body 5.

The movable upper sleeve 13 is connected to suitable shifting means, e.g. a linear motor or a screw-nut mechanism or also a pneumatic or fluid dynamic cylinder which is connected with its body to the upper supporting structure 11 and which is oriented with its axis parallel to the axis of the movable upper sleeve 13.

The shifting means can be actuated for shifting the movable upper sleeve 13 along its axis with respect to the fixed upper sleeve 12.

Preferably, both the lower end of the lower portion 2 and the upper end of the upper portion 3 can be connected under control to pneumatic suction means 90, which are known and shown for the sake of simplicity in a schematic manner only, so as to generate a suction upwards or downwards through the tubular body 5.

In the preferred case where the turning device 1 is installed, as shown, on a sewing or grafting station S, in this sewing or grafting station S is arranged a sewing or grafting station S1, e.g. as described in the aforesaid prior documents.

The turning device 1 can be integrated with other sensors, not shown in detail for the sake of simplicity, so as to control the shifting of the various movable mechanisms making up the turning device 1. The various sensors and the various actuators required for actuating the movable mechanisms of the turning device 1 are operatively connected to a programmable, electronic control mechanism U, which monitors the operation of the turning device 1. This control mechanism U can include a single control mechanism monitoring both the operation of the turning device 1 and the operation of the circular knitting machine used for manufacturing the items 100 based on preset operating programs.

The present invention shall now be discussed in further detail, and especially the technical features of the device 1 enabling the loading and insertion of the tubular item 100 into the tubular body 5 through the upper axial end 6A thereof.

As shown by way of example in the figures, the device according to the present invention comprises moving mechanisms 30 configured for selectively positioning the lower portion 2 at least between a first operating position, in which the lower portion 2 is vertically aligned with the upper portion 3, and a second operating position, in which the lower portion 2 is at least partially displaced laterally with respect to the upper portion 3, preferably getting closer to the knitting machine; in the second operating position, the tubular body 5 is supported by the lower portion (i.e. the lower actuating means hold the tubular body 5 in the lowered position).

Figure 9:
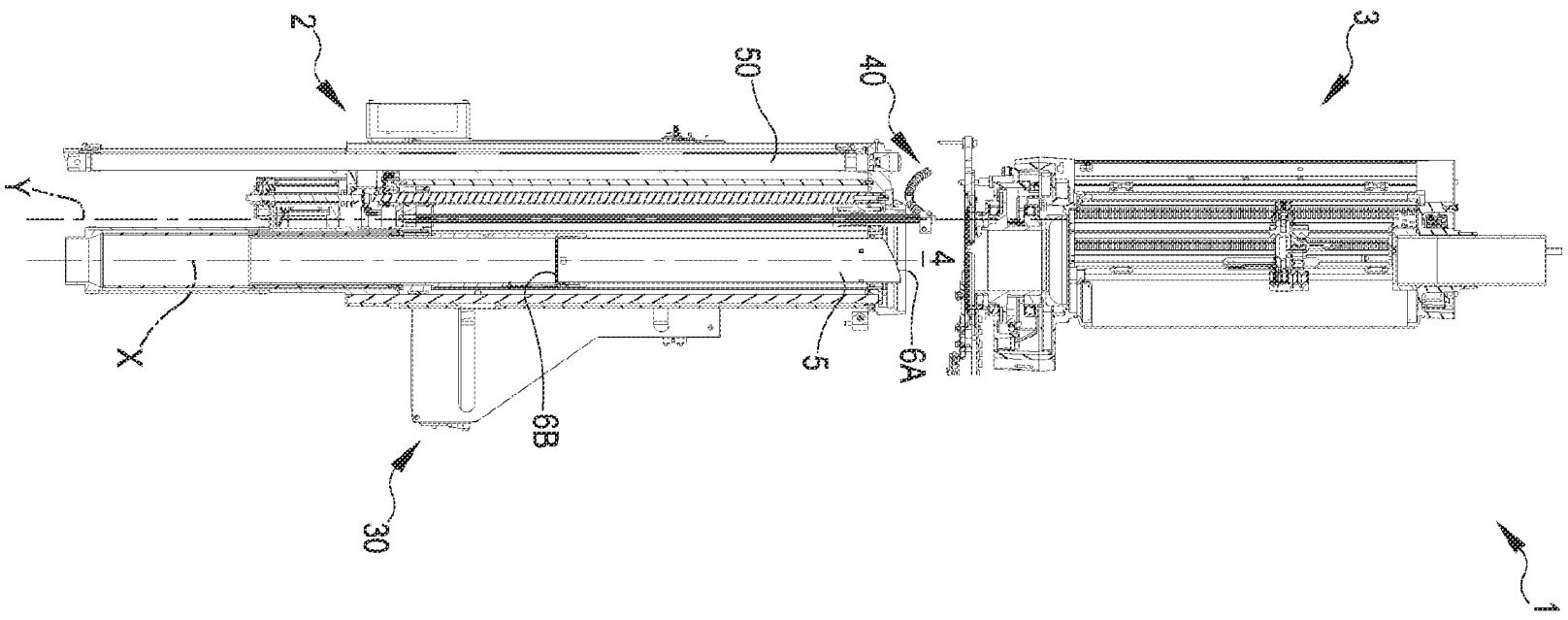
FIGS. 9, 10, 11 (and its magnification 11A), 12, 13 and 14 schematically show the turning device, sectioned and arranged with its axis in vertical direction, in six different operating configurations (described below)
Figure 10:
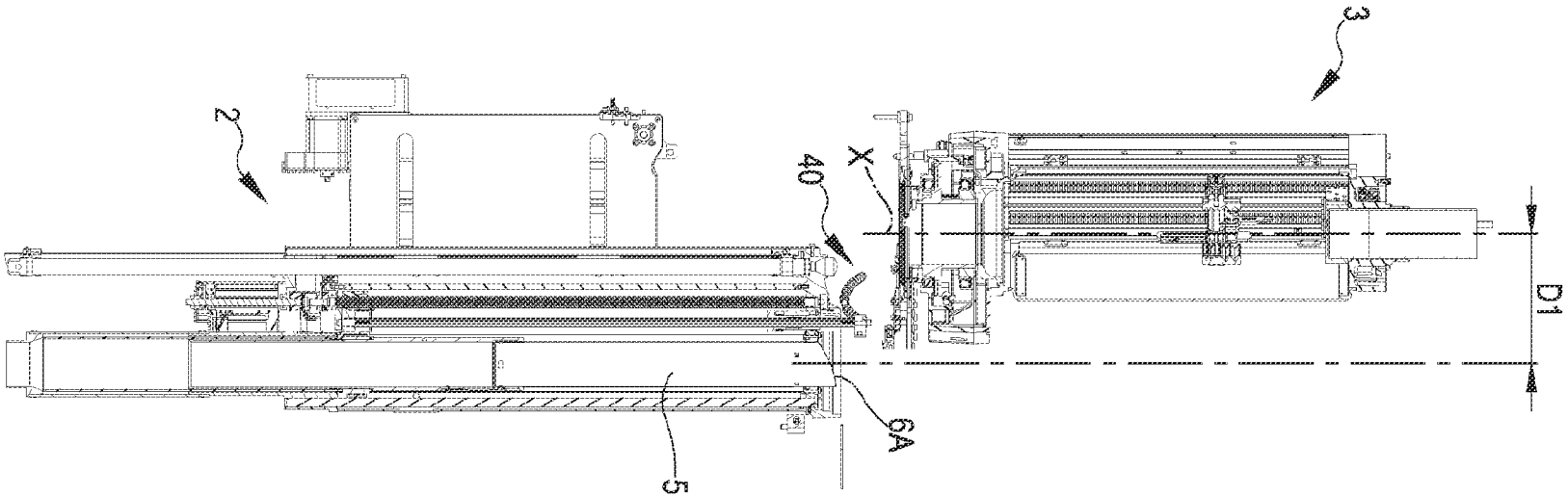
Figure 12:
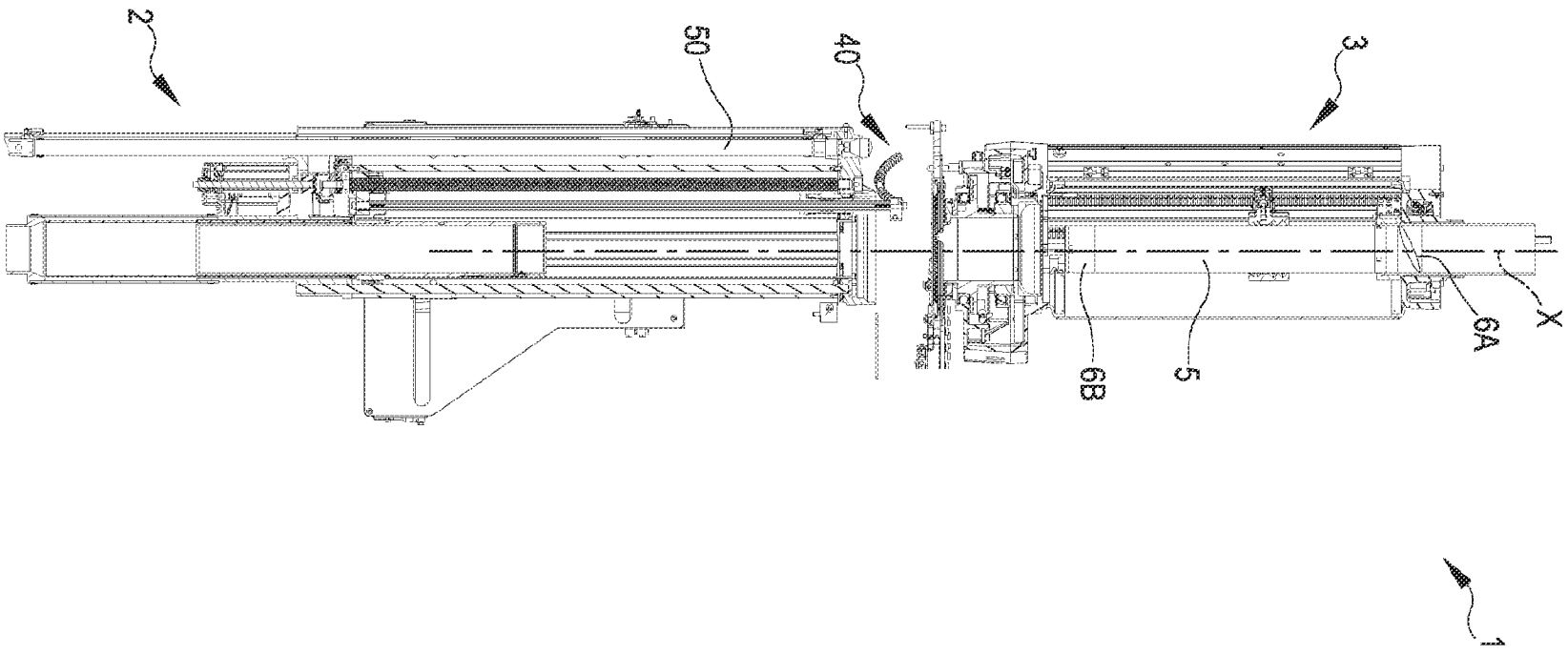

The first operating position is shown in FIGS. 9 and 12, whereas the second operating position is shown in FIGS. 10, 11 and 11A.

It should be pointed out that, when the lower portion is in the first position, the lower portion 2 and the upper portion 3 are placed coaxial to one another, along the main axis X of the turning device 1. Also the tubular body is placed with its longitudinal axis on the main axis X and can move upon control vertically along the whole device.

The device 1 further comprises at least one manipulating mechanism 40. This manipulating mechanism 40 is movable upon control at least between a non-operating position, in which it does not interact with the tubular item 100 (e.g. it is moved away from the moving trajectory of the tubular item), and a respective operating position, in which it is at least partially placed above the tubular body 5 supported by the lower portion 2. The non-operating position is shown in FIGS. 9-10 and 12-14, whereas the operating position is shown in FIGS. 11 and 11A.

Preferably, the switching of the manipulating mechanism 40 from the non-operating position to the operating position takes place by at least partially catching the tubular item 100 picked up by the knitting machine M and placed close to said lower portion 2. In particular, the manipulating mechanism 40, when in the operating position, is configured for manipulating and raising at least partially the tubular item 100, so as to place the second, free end B of the tubular item on the upper axial, open end 6A of the tubular body 5; thus the manipulating mechanism 40 causes and/or helps the insertion of the tubular item into the tubular body 5.

Preferably, the manipulating mechanism 40 is configured, when in the operating position, for catching and raising a middle portion C of the tubular item 100 placed in a continuous manner between the first end A and the second end B, so as to raise the second end B and orient it correctly at the entry of the upper axial end 6A of the tubular body 5.

This operation is shown in FIG. 11A, which shows the effect of the interaction between the manipulating mechanism 40 and the tubular item 100 (hanging with its first end A from the supporting means, and in particular from the aforesaid manipulating device 70).

Preferably, the switching of the lower portion 2 between the first operating position and the second operating position takes place by shifting, along a direction preferably perpendicular to said main axis X; this translation is horizontal in the figures.

Preferably, in the second operating position the lower portion 2 is shifted laterally, towards the knitting machine M used for manufacturing the tubular item, of a first distance D1 with respect to the first operating position.

Preferably, the moving mechanisms 30 comprise a slide or carriage having a fixed part, integral with the knitting machine M, and a movable part, onto which the lower portion 2 is integrally mounted.

Preferably, the movable part can be shifted with respect to the fixed part by means of a linear actuator, e.g. a linear motor, a fluid dynamic cylinder or a screw-nut mechanism.

Preferably, the manipulating mechanism 40 comprises a first linear actuator 41 provided with a base body 42, integral with the knitting machine M or with the lower portion 2 of the turning device (as in the embodiment of the figures), and a movable body 43, which can be shifted with respect to the base body 42.

Preferably, the movable body 43 can be shifted along a raising axis Y parallel to said main axis X.

Preferably, the raising axis Y is laterally spaced from the main axis X.

Preferably, the movable body 43 is configured for rising vertically from below to above, when the manipulating mechanism 40 reaches the aforesaid operating position, above the tubular body 5 supported by the lower portion 2, when the latter is shifted by the moving mechanisms 30 to the second operating position. This condition is represented by way of example in FIG. 11.

Preferably, the movable body 43 of the manipulating mechanism 40 ends with a supporting element 44 configured for supporting outside (i.e. from its outer surface) the tubular item 100 to be turned, hanging at its first end A from the supporting means. The supporting element 44 receives resting thereon the outer portion of the tubular item 100, in particular the middle portion C of the tubular item, and raises the whole tubular item to a given height so as to place the second, free end B of the tubular item at the upper axial, open end 6A of the tubular body 5.

Preferably, as shown by way of example in the figures, the supporting element 44 has a rod-like shape 45 (or rod-like element) suitably shaped so as to receive resting thereon and to support the tubular item 100 caught when getting close to the lower portion 2.

Preferably, this suitably shaped rod 45 comprises one or more rollers 46 fit one after the other around the rod and free to rotate around it so as to promote the tubular item 100 to slide on the supporting element 44 during the insertion of the tubular item 100 into the tubular body 5.

In possible embodiments, the supporting element can be a pair of pliers or a hook or a hooked element.

Preferably, the manipulating mechanism 40:

- when in the non-operating position, exhibits said supporting element 44 in a backward position (FIGS. 9, 10, 12-14), in which it does not obstruct the space above the upper axial end 6A of the tubular body 5, and
- wherein in the operating position, exhibits the supporting element 44 in a forward position (FIGS. 11 and 11A), in which it lies in the space above the upper axial end 6A of the tubular body 5 so as to catch and manipulate the tubular item 100 picked up from the knitting machine and placed close to the lower portion 2.

Preferably, the switching of the supporting element 44 between the backward position and the forward position takes place by means of a rotation of the supporting element 44 around an axis, preferably coincident with the raising axis Y.

Figure 16:
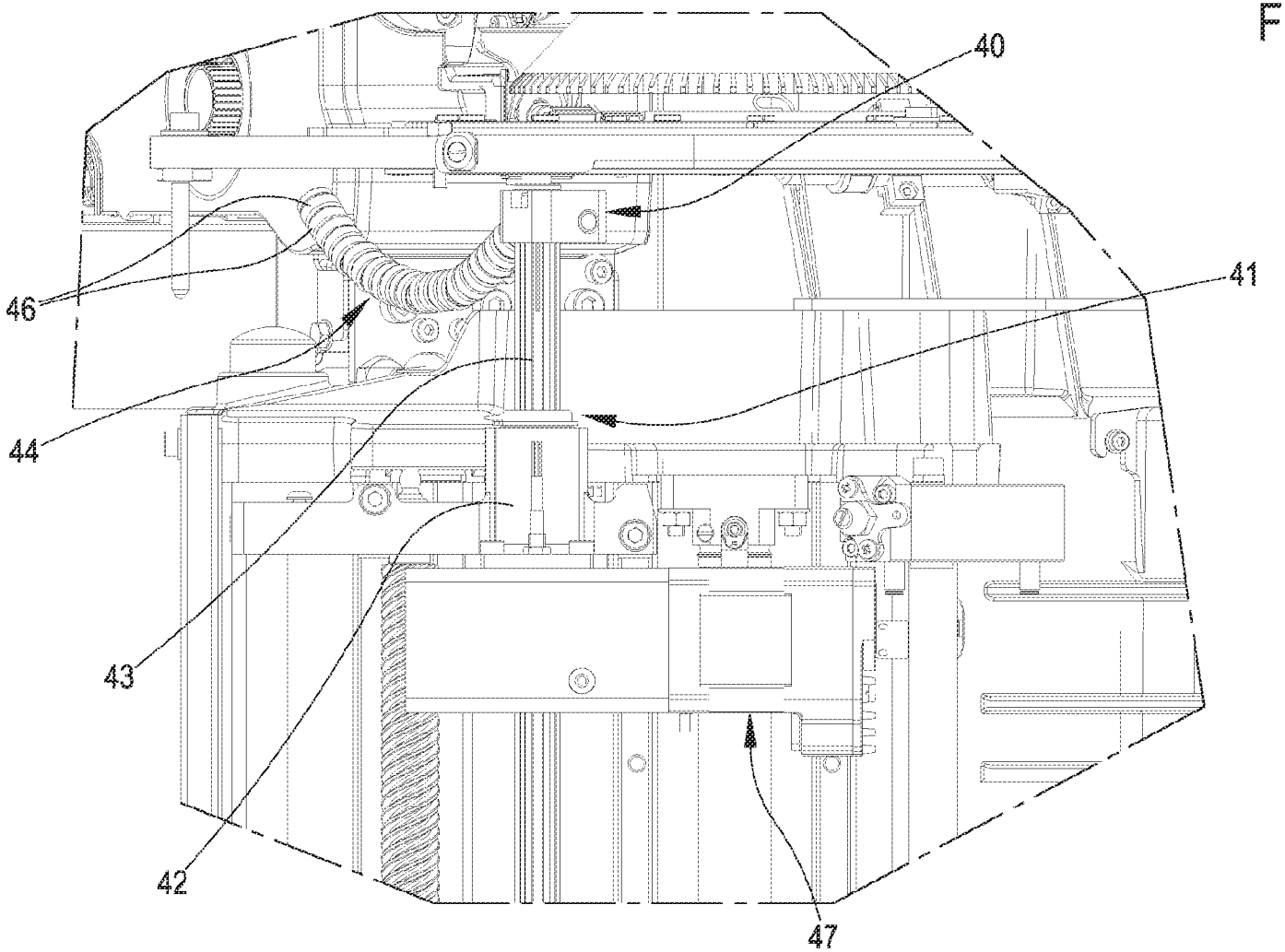
FIG. 16 is a magnification of a portion of the turning device for tubular knitted items in accordance with the present invention, some parts thereof being removed.

Preferably, the manipulating mechanism 40 comprises a forward actuator 47 (see FIG. 16) configured for selectively moving the supporting element 44 between the backward position and the forward position. The forward actuator 47 can act upon said movable body 43 (shaped as a piston moving along the axis Y) to cause a rotation thereof, so that the rotation of the movable body 43 results also in a rotation of the supporting element 44 mounted to the movable body 43 (in particular to its upper end), between said backward and forward positions.

Preferably, the base body 42 is a fluid dynamic cylinder and the movable body 43 is a piston that can be selectively shifted with respect to the cylinder and ends with the supporting element 44.

Preferably, the device 1 comprises a counter-turning mechanism 50, configured for operating and/or helping a counter-turning of the tubular item 100 once the first upper end A thereof has been closed. This counter-turning mechanism 50 is configured for being vertically inserted, from below to above, into the lower axial end 6B of the tubular body 5, supported by the upper portion 3, on whose outer side surface the tubular item 100 is wound, due to the previous turning caused by the insertion from below to above of the upper axial end 6° of the tubular body 5 through the first end A to be closed of the tubular item 100 hanging from the supporting means. This is basically the configuration of FIG. 12.

Preferably, the counter-turning mechanism 50 is associated and integral with said lower portion 2 and is arranged outside the tubular body 5.

Preferably, the counter-turning mechanism 50 can be shifted along a vertical direction Z aligned with said main axis X.

Figure 13:
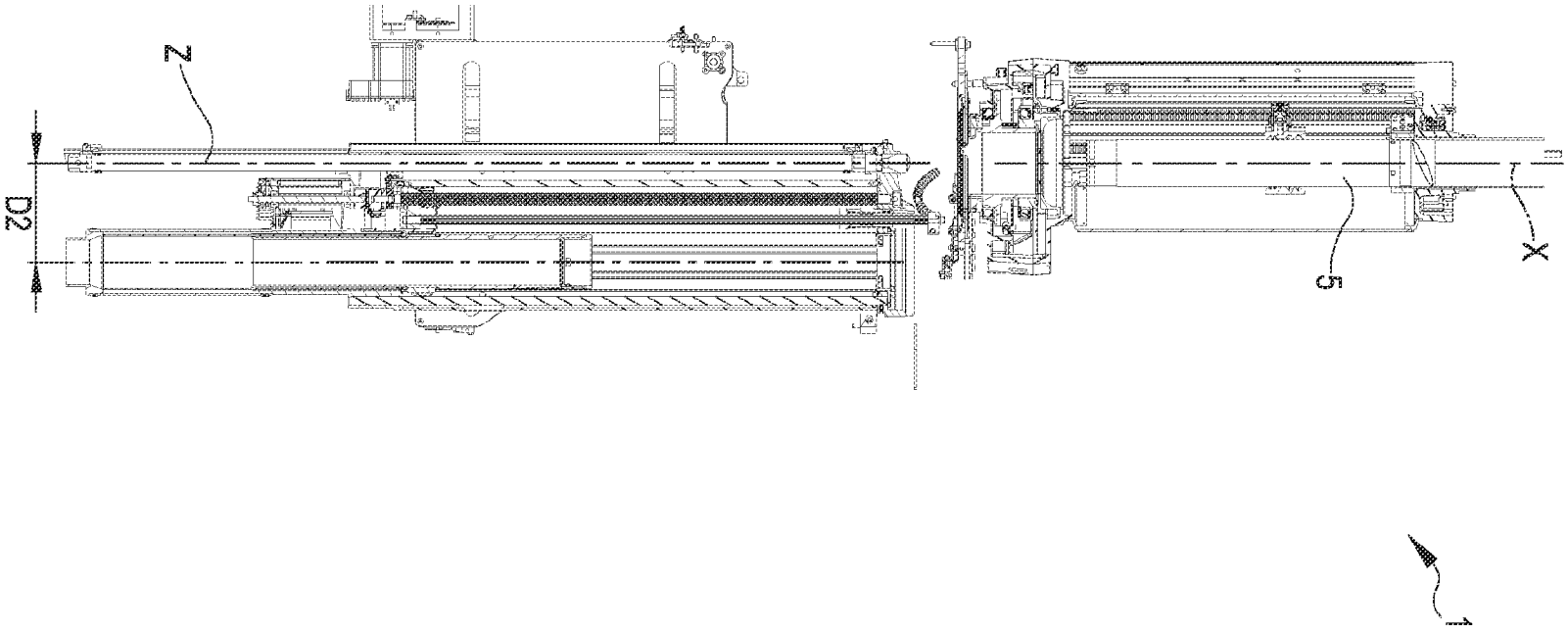
Figure 14:
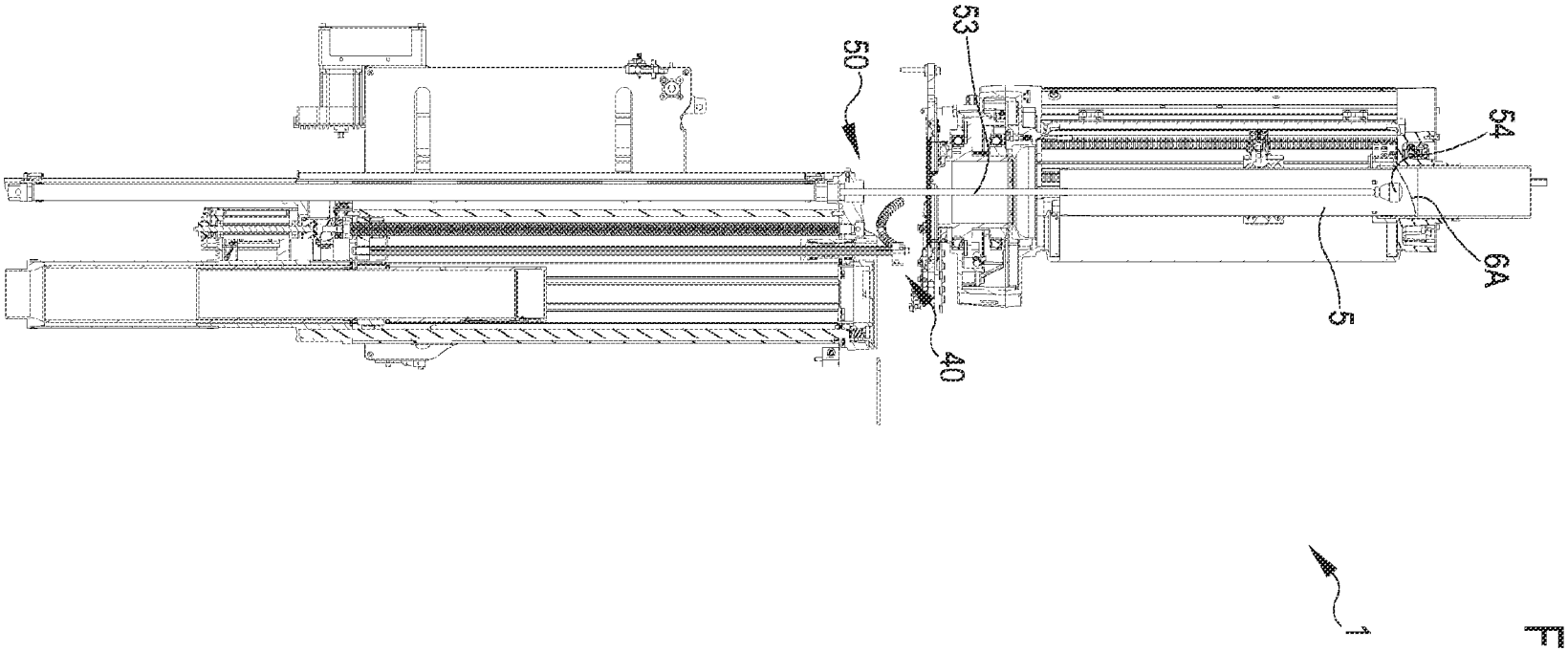

Preferably, the moving mechanisms 30 are configured for selectively positioning the lower portion 2 in a third operating position, differing from the first and second operating position, in which the lower portion 2 is shifted laterally with respect to the upper portion 3, so that the counter-turning mechanism 50 is vertically aligned below the lower axial end 6B of the tubular body 5, supported by the upper portion (i.e. with the vertical direction Z coincident with the main axis X). The third operating position is shown in FIGS. 13 and 14.

Preferably, the switching of the lower portion 2 between the first operating position and the third operating position takes place by shifting, along a direction preferably perpendicular to the main axis X. Preferably, as in the embodiment shown in the figures, the switching of the lower portion between the first operating position and the third operating position takes place along the same direction as the switching from the first operating position and the second operating position.

Preferably, in the third operating position the lower portion 2 is shifted laterally, preferably towards the knitting machine M, of a second distance D2 with respect to the first operating position. Preferably, the value of this second distance D2 differs from the value of the aforesaid first distance D1.

Preferably, the counter-turning mechanism 50 is mounted integrally to the movable part of the slide or carriage of the moving mechanisms 30.

Preferably, the counter-turning mechanism 50 comprises a second linear actuator 51 provided with a respective base body 52, integral with the knitting machine M or with the lower portion 2 of the turning device (as in the embodiment of the figures), and a respective movable body 53, which can be shifted with respect to the base body 52.

Preferably, the respective movable body 53 can be shifted along a counter-turning axis (corresponding to the vertical direction Z) parallel to or coincident with said main axis X.

Preferably, when the lower portion 2 is in the third operating position, it is laterally spaced from the main axis X of a value corresponding to the second distance D2, the counter-turning axis Z thus coinciding with the main axis X.

Preferably, the respective movable body 53 is configured for being vertically inserted from below to above inside the tubular body 5 supported by the upper portion 3, when the latter is shifted by the moving mechanisms to the third operating position.

Preferably, the respective movable body 53 of the counter-turning mechanism 50 ends with a respective pushing element 54 configured for pushing the tubular item 100 to be counter-turned, closed at the first end A thereof and wound outside the tubular body 5, inside the lower axial end 6B of the tubular body, starting from its first closed end, thus counter-turning the tubular item and pushing it out of the upper axial end 6A of the tubular body 5. This condition is represented by way of example in FIG. 14.

Preferably, the respective base body 52 is a respective fluid dynamic cylinder and the respective movable body 53 is a respective piston that can be selectively shifted with respect to the cylinder and ends with the respective pushing element 54.

The turning device according to the present invention, in the preferred case where it is used in a sewing or grafting station for closing an axial end of tubular knitted items, works as follows.

First of all, it should be pointed out that the steps in which the tubular item 100 is picked up from the knitting machine M, transferred to the manipulating device 60, turned by the turning tube 5, and the first axial end A of the tubular item 100 is closed, can advantageously be the same as shown, as far as the operating cycle is concerned, in the patent documents mentioned above; thus these steps are shown here in a schematic manner only. Moreover, wherever possible, devices, units and mechanisms as shown in the prior documents can also be used in the operating cycle of the turning device according to the present invention.

Conversely, the operations involving the raising and insertion of the tubular item 100, picked up from the knitting machine M, into the turning tube, are particular aspects of the device and of the method according to the present invention.

Reference should be made in particular to FIGS. 9-14.

FIG. 9 shows the device 1 in a rest condition or at the beginning of the operating cycle: the tubular body 5 is supported by the lower portion 2, completely lowered and with its axis coinciding with the main axis X and the axis 61A of the body of the manipulating device 60; the moving mechanisms are therefore positioning the lower portion 2 in the first operating position and the manipulating mechanism 40 is in the non-operating position.

Once the item 100 to be turned has been picked up from the knitting machine M used for manufacturing it, in case of using a picking device 70 designed to transfer the item 100 to the manipulating device 60 that will support it during the turning operation, the picking body 71, which holds the knitted loops of the last knitted course of the item 100 (i.e. the first end A) on its picking mechanisms 72, is placed with its axis 71A on the axis 61A below the body 61 of the manipulating device 60 (as shown in the figures). Basically, the supporting means from which the tubular item picked up from the knitting machine is hanging, are placed in the intermediate area 4 of the device 1.

In order to start loading the tubular item 100 onto the device 1 by inserting the item into the tubular body 5, the moving mechanisms 30 place the lower portion 2 in the second operating position, whereas the manipulating mechanism 40 remains in the non-operating position: this configuration is shown in FIG. 10. The lower portion 2, carrying the tubular body 5 lowered, is thus advantageously close to the item hanging from the supporting means, with the manipulating mechanism 40 placed beside the tubular body 5.

It should be pointed out that the mutual positioning of the tubular item 100 by the supporting means with respect to the lower portion 2 placed in said second operating position, occurs so that the tubular item 100 covers or gets through or crosses, at least partially, the upper end 6A of the tubular body 5. Now the loading operation is completed by shifting the manipulating mechanism 40 to its operating position (with the supporting element 44 shifted to the forward position), in which it is placed above the tubular body 5 supported by the lower portion: this raising makes the manipulating mechanism 40 catch the tubular item 100 so that the manipulating mechanism 40 manipulates and raises at least partially the tubular item 100, placing the second free end B of the tubular item on the upper axial, open end 6A of the tubular body 5; this causes or facilitates the insertion of the tubular item 100, starting from its second end B, into the tubular body 5. This configuration is shown in FIGS. 11 and 11A. The insertion occurs because the tubular item 100 covers or gets through or crosses the upper end 6A of the tubular body 5 for a sufficient area so that the manipulating mechanism 40 catching the tubular item causes the second end B to be raised and the tubular item to be positioned or at least partially inserted into the tubular body 5. Stated otherwise and by way of example, the item 100 hanging from the supporting means is shifted to as to "swing" above the upper end 6A of the tubular body 5, and when the manipulating mechanism 40 is shifted to the operating position, it raises from outside the tubular item (i.e. it acts upon the outer portion of the item) and positions the second end B correctly and inserts it into the underlying tubular body 5.

It should be pointed out that the steps shown in FIGS. 9-11 are preferably implemented with the pneumatic suction means 90 acting upon the lower end of the lower portion 2, so as to create a suction to the inside of the turning tube 5 placed in the lower portion. The lower portion (shifted to said second position) getting closer to the tubular item hanging from the supporting means (in particular from the picking mechanisms 72 of the picking device 70) and raised by the manipulating mechanism 40 simplifies the suction, inside the tubular body 5, through the upper axial end 6A of the latter.

Then the manipulating mechanism 40 is shifted back to the non-operating position, i.e. it is lowered with respect to the tubular body 5 and inserted into its seat again; moreover, the moving mechanisms 30 shift the lower portion 2 back to the first operating position; this configuration is shown in FIG. 12.

Now the tubular item 100 is correctly inserted into the tubular body 5 and supported by the supporting means.

It should be pointed out that the insertion of the tubular item 100 into the tubular body 5 can be carried out before, during or after the transfer of the item itself from the picking device 70 to the manipulating device 60.

In the same manner, the transfer of the item 100 from the machine used for manufacturing it to the sewing or grafting station S, i.e. from the picking device 70 to the manipulating device 60, can be carried out before or after the insertion of the item into the tubular body 5. The transfer of the tubular item from the picking device 70 to the manipulating device 60 occurs by placing the picking body 71 facing the two half-crowns 63*a*, 63*b*, in coplanar position, of the body 61 of the manipulating device, so that each of the picking mechanisms 72 is coupled with a respective tip 62. Suitable, e.g. known means push the knitted loops causing each knitted loop to individually switch from its picking mechanism 72 to the respective tip 62. Thus, each tip 62 carries a knitted loop of the last knitted course formed by the needles of the machine used for manufacturing the item, and the tubular item hangs from the manipulating device.

The tubular item can now be turned from its plain side to its turned side.

The turning operation begins by raising, along the axis X, the tubular body 5 which crosses with its upper axial end 6A the picking body 71 and the body 61 of the manipulating device 60 getting through the hollow cylinder 65 and reaching the raised position (FIG. 12). This upward movement of the tubular body 5 turns the item 100 hanging with its last knitted course (i.e. with its first end A) from the tips 62. The raising of the tubular body 5 is stopped when its lower axial end 6B is immediately above the body 61 made up of the two half-crowns 63*a*, 63*b* which are still in coplanar position. If the item 100 has a smaller length than the axial size of the tubular body 5, it is sufficient to shift the tubular body 5 upwards only to complete the turning of the item 100, which is completely wound onto the outer surface of the turning tube.

Should the item 100 be longer, its turning onto the outer side surface of the tubular body 5 is completed by auxiliary sliding means, e.g. rotating rollers or shifting pressers. The complete turning inside out of the item 100 onto the outer side surface of the tubular body 5 can be detected by means of an optical sensor, consisting for instance of a photocell facing the upper edge of the tubular body 5, which inhibits the actuation of the auxiliary sliding means if their intervention is not necessary, or stops their actuation when the item is turned inside out.

Once the item 100 is turned and is now turned inside out, keeping the tubular body 5 raised and supported by the upper portion 3, the first axial end A of the tubular item 100 is closed by sewing or grafting.

Then the item with its first end closed is disengaged from the manipulating device, i.e. from the tips 62.

Then the closed tubular item can be unloaded, i.e. pushed out of the device 1. Preferably, first the pneumatic suction means 90 on the upper end of the upper portion 3 are activated, so as to create a suction towards the inside of the turning tube 5, from its lower axial end 6B, placed in the upper portion.

As a result of the suction, the item 100 is sucked starting from its first end A just closed into the tubular body 5 through the lower axial end 6B of the tubular body 5.

The suction of the item 100 starting from its first end just closed, through the lower axial end 6B of the tubular body 5, counter-turns the item 100, which is thus brought back to its plain side.

The aforesaid counter-turning mechanism 50 can intervene in order to carry out or help this counter-turning of the item 100.

In further detail, the moving mechanisms 30 shift the lower portion 2 to the aforesaid third operating position, so that the vertical direction Z coincides with the main axis X, i.e. the counter-turning mechanism 50 is vertically aligned with the turning tube 5 placed in the upper portion 3. This configuration is shown in FIG. 13.

Then the counter-turning mechanism 50 is actuated so as to be inserted vertically, from below to above, into the lower axial end 6B of the tubular body 5, supported by the upper portion, on whose outer side surface the tubular item closed at its first end is wound. Thus the counter-turning mechanism 50 pushes upwards the tubular item 100 into the turning tube 5, counter-turns it and shifts it to the upper end of the turning tube, and from here to the upper end of the upper portion 3, on which the tubular item can be pushed out. This configuration is shown in FIG. 14.

It should be pointed out that the steps shown in FIGS. 13-14 are preferably implemented with the pneumatic suction means 90 acting upon the upper end of the upper portion 3, so as to create an upward suction inside the turning tube 5, which helps the closed item to be counter-turned and pushed out at the end of the operating cycle.

After the item 100 has been taken out of the device 1, the various parts are shifted back to the condition shown in FIG. 9 and the device is ready to receive a new item 100 to be closed at its first axial end A.

Preferably, the steps of the operating cycle of the device 1 of the present invention are preferably carried out in a sequence according to what has been shown in FIGS. 9-14.

Obviously, the turning device according to the invention, though being conceived to be preferably used in sewing or grafting stations in which tubular knitted items are closed in an automated manner at an axial end thereof, can also be used for turning tubular items only. In this case, the device works in the same manner as described, except for the fact that there are not steps in which the item is prepared for sewing or grafting and the item, once turned inside out, is not turned again to be brought back to its plain side.

Figure 15:
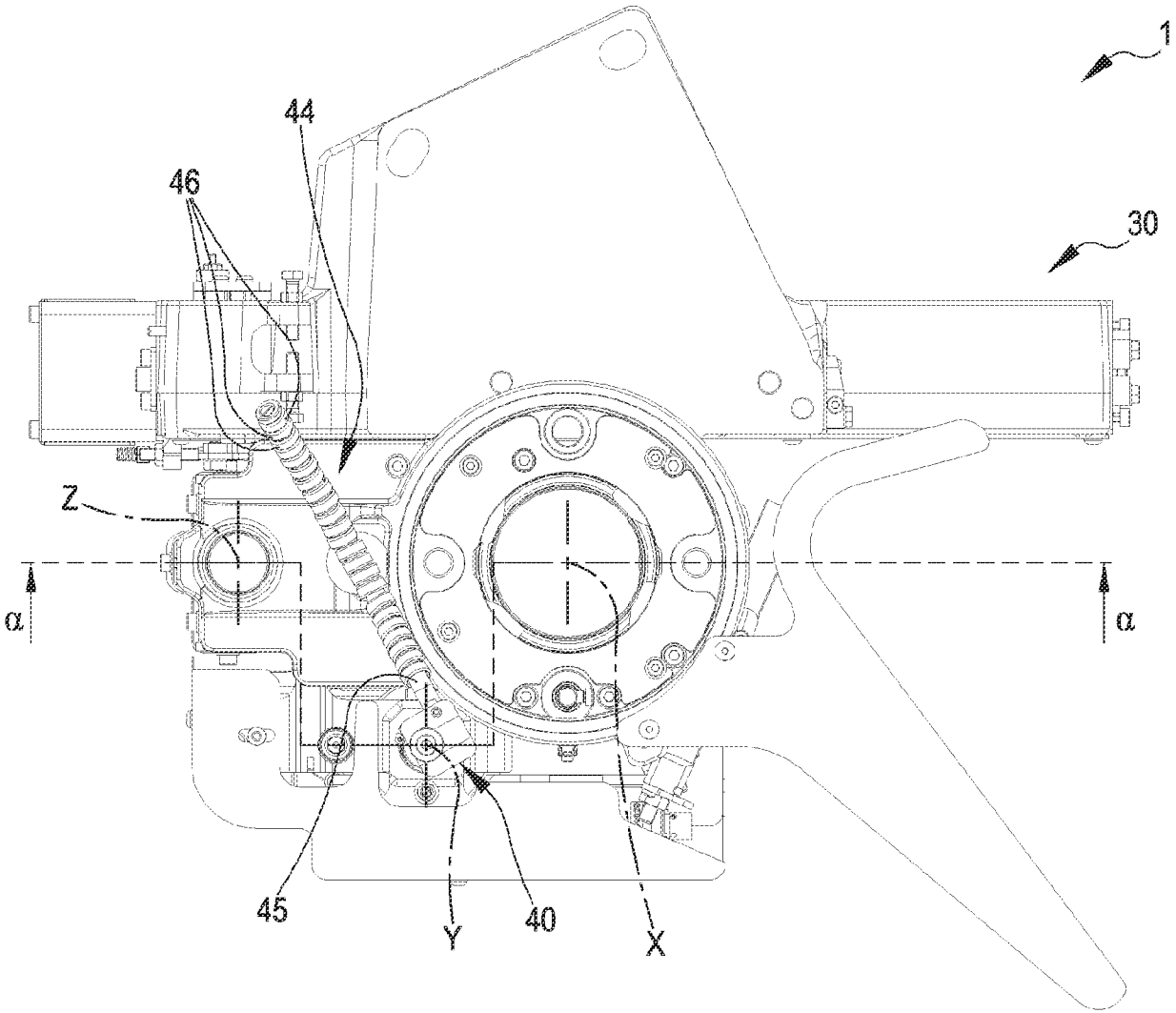
FIG. 15 is a plan view of the turning device of the preceding figures; such figure further shows the plane α-α (defined with a hatched line) with respect to which all the sections in the preceding

For the sake of completeness, it should be pointed out that FIG. 15 shows the device 1 from above and highlights the plane α-α with respect to which all the section of the preceding FIGS. 5-14 have been obtained. This plane α-α is defined by a hatched line, so as to obtain sections showing the various parts more clearly. In FIG. 15 the lower portion 2 of the device is in the aforesaid first position.

In FIG. 15 it is also possible to see the manipulating mechanism 40, the counter-turning mechanism 50, the main axis X, the raising axis Y and the counter-turning axis Z.

The invention achieves important advantages.

First of all, the invention allows to overcome the drawbacks of prior art.

In particular, the invention allows to carry out a turning device for tubular knitted items which can correctly turn the tubular items.

Moreover, the invention allows to carry out a turning device which ensures the correct loading and turning also of heavy or thick items, or of long or also of very stiff items.

Moreover, the invention allows to carry out a turning device with a high reliability and operating accuracy.

Moreover, the invention allows to carry out a turning device characterized by a simple and rational structure.

The invention claimed is:

1. A turning device (1) for tubular knitted items (100), said tubular items (100) being manufactured by means of a circular knitting machine (M) for knitted or hosiery items and extending longitudinally between a first end (A) and a second end (B), both open, the device (1) comprising:

a lower portion (2) and an upper portion (3), placed below and above an intermediate area (4), respectively, on which are positioned supporting means for the tubular item (100) to be turned, hanging at the first end (A) thereof, with the second end (B) being free, and arranged vertical;

at least one tubular body (5) to be inserted from below to above, with an upper axial end (6A) thereof, through said first end (A) of the item hanging from said supporting means after inserting the tubular item through said upper axial end (6A) of the tubular body (5), for turning inside out the tubular knitted item (100), held by said supporting means, on the outer side surface of said tubular body (5), progressively taking the tubular item out of said upper axial end (6A) of the tubular body (5), so as to turn the tubular item (100) with respect to the configuration with which it hangs from the supporting means;

the device (1) further comprising:

moving mechanisms (30) configured for selectively positioning said lower portion (2) at least between a first operating position, in which said lower portion (2) is vertically aligned with said upper portion (3), and a second operating position, in which said lower portion (2) is at least partially displaced laterally with respect to said upper portion (3), and wherein, in said second operating position, said tubular body (5) is supported by said lower portion (2);

a manipulating mechanism (40), movable upon command at least between a non-operating position, in which it does not interact with the tubular item, and an operating position, in which it is at least partially placed above said tubular body (5) supported by the lower portion (2);

wherein the switching of the manipulating mechanism (40) from the non-operating position to the operating position takes place by at least partially catching the tubular item (100) picked up by the knitting machine and placed close to said lower portion (2), wherein the manipulating mechanism (40), when in said operating position, is configured for manipulating and raising at least partially the tubular item (100), so as to place the second, free end (B) of the tubular item on the upper axial, open end (6A) of the tubular body (5), so as to cause or simplify the insertion of the tubular item (100), starting from the second end (B) thereof, into the tubular body (5).

2. The device (1) according to claim 1, wherein the manipulating mechanism (40) is configured, when in said operating position, for catching and raising a middle portion (C) of the tubular item placed in a continuous manner between the first end (A) and the second end (B), so as to raise the second end (B) and orient it at the entry of the upper axial end (6A) of the tubular body (5).

3. The device (1) according to claim 1, wherein the lower portion (2) and the upper portion (3) exhibit each a respective longitudinal development along a vertical axis thereof, and are positioned, when the lower portion is in said first position, coaxial one to the other, along a main axis (X) of the turning unit (1), and wherein the tubular body (5) is capable to be positioned with its longitudinal axis on said main axis (X) and is movable upon control along said main axis (X).

4. The device (1) according to claim 1, wherein the switching of the lower portion (2) between said first operating position and said second operating position takes place by shifting, along a direction perpendicular to said main axis (X), and wherein in said second operating position the lower portion (2) is shifted laterally, towards the knitting machine (M) used for manufacturing the tubular item, of a first distance (D1) with respect to the first operating position.

5. The device (1) according to claim 1, wherein said manipulating mechanism (40) comprises a first linear actuator (41) provided with a base body (42), integral with the knitting machine (M), used for manufacturing the tubular item, or with said lower portion (2), and a movable body (43), which is capable to be shifted with respect to said base body (42), and wherein the movable body (43) is capable to be shifted along a raising axis (Y) parallel to said main axis (X), and wherein said raising axis (Y) is laterally spaced from said main axis (X).

6. The device (1) according to claim 1, wherein the movable body (43) of the manipulating mechanism ends with a supporting element (44) configured for supporting the tubular item (100) to be turned, hanging at its first end (A) from the supporting means, said supporting element (44) receiving resting thereon the outer portion of the tubular item (100) and raising the tubular item, or at least said middle portion (C) of the tubular item, to a given height so as to place the second, free end (B) of the tubular item at the upper axial, open end (6A) of the tubular body (5).

7. The device (1) according to claim 6, wherein the supporting element (44) has a rod-like shape (45) suitably shaped so as to receive resting thereon and to support the tubular item (100) caught when getting close to the lower portion.

8. The device (1) according to claim 6, wherein the supporting element (44) is a pair of pliers or a hook or a hooked element.

9. The device (1) according to claim 6, wherein the manipulating mechanism (40):

when in said non-operating position, exhibits said supporting element (44) in a backward position, in which it does not obstruct the space above the upper axial end (6A) of the tubular body (5), and wherein in said operating position, exhibits said supporting element (44) in a forward position, in which it lies in the space above the upper axial end (6A) of the tubular body (5) so as to catch and manipulate the tubular item (100) picked up from the knitting machine and placed close to said lower portion (2).

10. The device (1) according to claim 1, comprising a counter-turning mechanism (50), configured for operating or helping a counter-turning of the tubular item (100) once the first end (A) has been closed, wherein said counter-turning mechanism (50) is configured for being vertically inserted, from below to above, into a lower axial end (6B) of the tubular body, supported by said upper portion (3), on whose outer side surface the item is wound, due to the previous turning caused by the insertion from below to above of the upper axial end (6A) of the tubular body (5) through the first end (A) to be closed of the item hanging from said supporting means, and/or wherein said counter-turning mechanism (50) is associated and integral with said lower portion (2) and is arranged outside said tubular body (5), and/or wherein said counter-turning mechanism (50) is capable to be shifted along a vertical direction (Z) parallel to or coincident with said main axis (X).

11. The device (1) according to claim 10, wherein the moving mechanisms (30) are configured for selectively positioning said lower portion (2) in a third operating position, differing from said first and second operating position, in which said lower portion (2) is at least partially shifted laterally with respect to said upper portion (3), so that the counter-turning mechanism (50) is vertically aligned below the lower axial end (6B) of the tubular body (5), supported by said upper portion (3), and/or wherein the switching of the lower portion (2) between said first operating position and said third operating position takes place by shifting, along a direction perpendicular to said main axis (X), and/or wherein in said third operating position the lower portion (2) is shifted laterally, towards the knitting machine (M) used for manufacturing the tubular item, of a second distance (D2) with respect to the first operating position, and/or wherein said counter-turning mechanism (50) is mounted integrally with said movable part of said moving mechanisms (30).

12. The device (1) according to claim 1, wherein said supporting means of the item to be turned comprise a manipulating device (60) provided with a body (61) shaped as a circular crown, arranged with its axis (61A) on the main axis (X) and supporting a plurality of tips (62) arranged according to an ideal cylindrical surface, whose axis coincides with the axis (61A) of said body (61) of the manipulating device (60), and apt to support the tubular item (100) to be turned and hanging at its first end, and/or wherein the inside of said tubular body (5) is connected to pneumatic suction means (90) so as to suck through its upper axial end (6A) the tubular item (100) which is however held, at its first end (A) to be closed, by the picking device or by the manipulating device, thus placing the item inside the tubular body, and/or wherein the tubular body (5) is movable upon command at least from a lowered position, in which it faces with its upper axial end (6A) below said body (61) of the manipulating device (60), to a raised position, in which it is arranged with its upper axial end (6A) above said body (61) of the manipulating device (60) and with its lower axial end (6B) close to said body of the manipulating device, so as to get through said body of the manipulating device and turn inside out at least partially the tubular item (100), hanging from said manipulating device (60) and sucked through the upper axial end (6A) of said tubular body (5), on the outer side surface of said tubular body, and vice versa.

13. A circular knitting machine (M) for knitted or hosiery items, comprising:

stitch formation mechanisms, for instance a needle-holding cylinder or a needle-holding plate provided with a plurality of needles, configured for manufacturing tubular knitted items, each item extending longitudinally between a first end (A) and a second end (B), both open;

a sewing or grafting station (S), comprising a sewing or grafting head (S1) configured for automated closing of the first end of the tubular item (100);

means for picking up and supporting the tubular item to be turned, configured for picking up the tubular item (100) manufactured by the stitch formation mechanisms and for transferring it to said sewing or grafting station, holding it supporting during the sewing or grafting operation for closing its axial end (A);

a turning device (1) according to claim 1, operatively placed between said stitch formation mechanisms and said sewing or grafting station (S), and configured for cooperating with said means for picking up and supporting the tubular item (100) so as to operate at least a controlled turning of the tubular item, and/or wherein said second operating position taken by the lower portion (2) of the turning device gets closer, preferably by shifting, to the stitch formation mechanisms or to the means for picking up and supporting the tubular item to be turned.

14. A method for turning tubular knitted items (100), designed to be implemented in sewing or grafting stations (S) for automated closing of tubular items at an axial end thereof, the method comprising:

arranging means for manufacturing tubular knitted items, said manufacturing means being a circular knitting machine (M) for knitted or hosiery items;

arranging a turning device (1) for tubular knitted items according to claim 1;

arranging supporting means for the tubular item to be turned, from which a tubular item hangs at a first end thereof and is arranged vertical;

positioning, by means of said moving mechanisms (30), said lower portion (2) in said second operating position, and positioning said manipulating mechanism (40) in said non-operating position;

shifting the tubular item (100), by means of said supporting means, on said lower portion (2), placed in second operating position, or on said intermediate area (4) of the turning device (1), so that the tubular item covers or gets through or crosses, at least partially, the upper end (6A) of the tubular body (5);

shifting said manipulating mechanism (40) to said operating position, in which it is at least partially placed above said tubular body (5) supported by the lower portion (2), catching and raising at least partially the tubular item (100) so as to position the second, free end of the tubular item on the upper axial, open end (6A) of the tubular body (5), thus causing or simplifying the insertion of the tubular item into the tubular body (5).

15. The method according to claim 14, comprising, after the insertion of the tubular item (100) into the tubular body (5), one of more of the following steps:

shifting said manipulating mechanism (40) back to said non-operating position;

placing, by means of said moving mechanisms (30), said lower portion (2) in said first operating position;

inserting the tubular body (5) from below to above, with the upper axial end (6A) thereof, through the first end of the item hanging from said supporting means, so as to cause the tubular item to be turned inside out, held by said supporting means, on the outer side surface of the tubular body (5), progressively taking the item out of said upper axial end of the tubular body, so as to turn the tubular item with respect to the configuration with which it hangs from the supporting means;

with the tubular body (5) raised and supported by the upper portion (3) of the turning device (1), closing, by sewing or grafting, the first end of the tubular item;

if necessary, placing, by means of said moving mechanisms (30), said lower portion (2) in said third operating position and actuating said counter-turning mechanism (50) so as to insert it vertically, from below to above, into the lower axial end (6B) of the tubular body (5), supported by the upper portion (3), on whose outer side surface the tubular item (100) is wound, so as to operate or help a counter-turning of the tubular item with the upper axial end closed;

pushing the tubular item (100) out of the upper axial end (6A) of the tubular body (5).

16. The device (1) according to claim 1, wherein the device is configured for operating with a sewing station (S) or a grafting station for automated closing of tubular knitted items (100) at a first end of the tubular knitted items.

17. The device (1) according to claim 1, wherein said moving mechanisms (30) comprise a slide or carriage having a fixed part, integral with the knitting machine used for manufacturing the tubular item, and a movable part, onto which is integrally mounted the lower portion (2), and wherein said movable part is capable to be shifted with respect to said fixed part by means of a linear actuator.

18. The device (1) according to claim 5, wherein said movable body (43) is configured for rising vertically from below to above, when the manipulating mechanism (40) reaches said operating position, above the tubular body (5) supported by the lower portion (2), when the latter is shifted by said moving mechanisms (30) to said second operating position.

19. The device (1) according to claim 7, wherein said suitably shaped rod (45) comprises one or more rollers (46) fit one after the other around the rod and free to rotate around it so as to promote the tubular item to slide on the supporting item during the insertion of the tubular item (100) into the tubular body (5).

20. The device (1) according to claim 6, wherein the switching of the supporting element (44) between the backward position and the forward position takes place by means of a rotation of the supporting element (44) around an axis, or wherein the manipulating mechanism (40) comprises a forward actuator (47) configured for selectively moving the supporting element (44) between the backward position and the forward position.

* * * * *